US007024145B2

(12) United States Patent
Aruga et al.

(10) Patent No.: US 7,024,145 B2
(45) Date of Patent: Apr. 4, 2006

(54) FIXING DEVICE FOR FIXING AN UNFIXED TONER IMAGE FORMED ON A SHEET-SHAPED RECORDING MEDIUM

(75) Inventors: Tomoe Aruga, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/872,195

(22) Filed: Jun. 18, 2004

(65) Prior Publication Data

US 2005/0008412 A1 Jan. 13, 2005

(30) Foreign Application Priority Data

Jun. 20, 2003 (JP) ..... P2003-176339
Jun. 20, 2003 (JP) ..... P2003-176340
Jun. 20, 2003 (JP) ..... P2003-176341
Jun. 26, 2003 (JP) ..... P2003-182048
Jun. 26, 2003 (JP) ..... P2003-182049

(51) Int. Cl.
*G03G 15/20* (2006.01)

(52) U.S. Cl. ..... 399/329

(58) Field of Classification Search ..... 399/329; 219/216

See application file for complete search history.

(56) References Cited

U.S. PATENT DOCUMENTS 4,682,878 A 7/1987 Takizawa et al.
5,999,788 A 12/1999 Kanesawa et al.
6,631,253 B1 * 10/2003 Nakafuji et al. ..... 399/329
2002/0125237 A1 9/2002 Ohno et al.
2003/0063931 A1 4/2003 Sanpei et al.

FOREIGN PATENT DOCUMENTS

| | | | |
|---|---|---|---|
| EP | 0 930 548 | | 7/1999 |
| EP | 1367461 | A2 * | 12/2003 |
| JP | 06-040235 | | 5/1994 |
| JP | 08-262903 | | 10/1996 |
| JP | 11-024463 | | 1/1999 |
| JP | 11-133771 | | 5/1999 |
| JP | 3084692 | | 7/2000 |
| JP | 2002-311735 | | 10/2002 |
| JP | 2003302852 | A * | 10/2003 |
| JP | 2004020901 | A * | 1/2004 |

* cited by examiner

*Primary Examiner*—Quana Grainger
(74) *Attorney, Agent, or Firm*—Hogan & Hartson, L.L.P.

(57) ABSTRACT

A fixing device for fixing an unfixed toner image formed on a sheet-shaped recording medium is disclosed. A first roller incorporates a heat source therein. A second roller is pressed toward the first roller. A part of an endless belt is wound on an outer periphery of the second roller to be circulated. A non-rotatable belt stretcher stretches the endless belt together with the second roller such that the circulated endless belt is slid on a first face extending in a widthwise direction of the endless belt, and such that a tensile force is applied to both widthwise end portions of the endless belt. The circulated endless belt is nipped between the first roller and the second roller to form a first nip portion through which the unfixed toner image is fixed on the recording medium with heat from the heat source. The first face is curved in the widthwise direction.

24 Claims, 19 Drawing Sheets

FIXING DEVICE FOR FIXING AN UNFIXED TONER IMAGE FORMED ON A SHEET-SHAPED RECORDING MEDIUM

BACKGROUND OF THE INVENTION

The present invention relates to a fixing device that fixes an unfixed toner image formed on a sheet medium. The fixing device comprises: a heating roller; a pressing roller that is pressed against the heating roller; a belt that moves by being wound around an outer periphery of the pressing roller and nipped between the pressing roller and the heating roller; and a belt stretcher over which the belt is stretched. The present invention also relates to an image forming apparatus incorporating such a fixing device.

An image forming apparatus such as a copying machine, a printer and a facsimile machine incorporates a heating roller type fixing device in which an unfixed toner on a recording medium is subjected to a press contact with heat to thereby fix the unfixed toner on the recording medium. Such a fixing device comprises: a rotatable heating roller coated with an elastic body on the surface thereof and housing a heat source therein; a belt stretched over plural supporting rollers, and a pressing member for forming a nip region by causing the belt to wind around the heating roller by a predetermined angle while causing the elastic body on the surface of the heating roller to undergo deformation by locally applying a larger pressure to the exit of the nip region than the other portions, thereby making it easier for a sheet medium to be discharged from the nip portion. Such a configuration is disclosed in Japanese Patent No. 3084692.

In the fixing device, the surface of the heating roller has been deformed in advance due to the presence of the pressing member, and the deformation on the surface is relieved momentarily while toner is in contact with the surface of the heating roller. For this reason, when a sheet medium is discharged from the nip portion, an contact force between the toner and the heating roller is reduced in inhibiting the sheet medium from winding around the heating roller, so that even a recording sheet of paper that is not very firm can be readily separated at the exit of the belt nip. This device thus eliminates the need for a separating claw member.

However, plural supporting rollers and the rotation bearings are required. Further, not only the peripheral length of the belt is extended, but also the fixing device becomes complex with an increase in both size and cost. The structure such that makes the fixing device complex with an increase in size and cost naturally makes the image forming apparatus equipped with such a fixing device complex with an increase in size and cost.

Moreover, the belt is heated at the nip portion with the rotatable heating roller housing the heat source; however, with the configuration in which the belt is stretched over plural rollers and its peripheral length is inevitably extended, heat energy is absorbed by plural supporting rollers when it moves along a predetermined path. In addition, natural heat release is increased with the peripheral length. This extends a time needed to reach a predetermined temperature, which in turn extends a so-called warm-up time needed for the fixing operation to be enabled since the apparatus has been activated. Hence, this configuration is not preferable.

Further, the configuration, in which deformation of the elastic layer on the heating roller is caused by winding the belt around the heating roller by an angle needed to form the nip and by applying a larger pressure locally at the exit of the nip portion than the other portions, is suitable in inhibiting a sheet medium from winding around the heating roller; however, the sheet medium discharged along the deformation of the elastic layer is distorted, by being curled along the deformation or wrinkled as a result of a local high pressure.

Japanese Patent Publication No. 6-40235B discloses a fixing device in which an unfixed toner image is fixed on a recording medium by passing through a nip region formed between roller members which are in press contact with each other. In this device, the rotating speed of the roller members can be set to either a first speed or a second speed in accordance with the characteristic of the recording medium.

However, since the heat capacity of the roller members are large, the warm-up time is extended. Moreover, the recording medium passing through the nip region formed by deforming the roller members with a pressure undergoes distortion, such as curls and wrinkles, because an applied stress induced by this pressure is large.

Japanese Patent Publication No. 8-262903A discloses a fixing device in which an endless belt stretched over a heating roller, which is coated with an elastic body on the surface thereof and housing a heat source therein, is run while being in contact with the heating roller, and a non-rotatable pressing pad, provided on the inner side of the endless belt to press the endless belt against the heating roller, not only forms a nip portion, but also causes the elastic layer on the surface of the heating roller to undergo deformation. A sheet medium bearing an unfixed toner image is forced to pass through a space between the heating roller and the endless belt for the toner to be fixed on the sheet medium. Since the pressing pad is not rotated, heat transmitted from the heating roller is hardly dissipated. Therefore it has an advantage that a quantity of heat absorbed from the heating roller is small.

Nevertheless, the warm-up time is extended because heat is transmitted to the pressing pad from the heating roller via the endless belt during the warm-up operation. In addition, three or more rollers are necessary to circulate the belt, which raises another problem that the device is increased in size.

SUMMARY OF THE INVENTION

It is therefore an object of the invention to provide a heating roller type fixing device which is simple, compact and cost-saving in the structure, and which is capable of shortening a warm-up time as well as suppressing the distortion of a discharged sheet medium (recording medium), such as the occurrence of curls and wrinkles, by reducing a stress applied to the sheet medium.

In order to achieve the above object, according to the invention, there is provided a fixing device for fixing an unfixed toner image formed on a sheet-shaped recording medium, comprising:

- a first roller, incorporating a heat source therein;
- a second roller, being pressed toward the first roller;
- an endless belt, a part of which is wound on an outer periphery of the second roller to be circulated; and
- a non-rotatable belt stretcher, which stretches the endless belt together with the second roller such that the circulated endless belt is slid on a first face extending in a widthwise direction of the endless belt, and such that a tensile force is applied to both widthwise end portions of the endless belt, wherein:
- the circulated endless belt is nipped between the first roller and the second roller to form a first nip portion through which the unfixed toner image is fixed on the recording medium with heat from the heat source; and the first face of the belt stretcher is curved in the widthwise direction of the endless belt.

Here, a widthwise center portion of the first face of the belt stretcher is made concave or convex from the both widthwise end portions thereof.

Preferably, the circulated endless belt is nipped between the first roller and the belt stretcher to form a second nip portion through which the unfixed toner image is fixed on the recording medium with heat from the heat source.

With the above configurations, since the both widthwise end portions of the endless belt are brought into close contact with the first face of the belt stretcher, the buckling of the endless belt at the second nip portion can be avoided. In addition, the total nipping length for the recording medium can be elongated to realize the stable fixing operation.

Here, it is preferable that the belt stretcher comprises a wall member having a second face adjacent to at least one of the both widthwise end portions of the endless belt, in order to restrict a wobbling motion of the circulated endless belt.

It is further preferable that the wall member is integrally formed with the belt stretcher. More preferably, the wall member is monolithically formed with the belt stretcher.

With the above configuration, the wobbling motion of the circulated endless belt can be eliminated so that the stable fixing operation can be realized.

It is also preferable that the second face of the wall member is continuously extended from the first face of the belt stretcher.

Here, it is further preferable that the second face of the wall member and the first face of the belt stretcher facing one of the widthwise end portions of the endless belt form a first angle. A side end face of the endless belt and the first face of the belt stretcher facing one of the widthwise end portions of the endless belt form a second angle which is smaller than the first angle.

With the above configurations, the bucking of the widthwise end portion of the circulated endless belt can be avoided more effectively.

It is also preferable that a height dimension of the wall member is larger than a thickness dimension of the endless belt.

It is also preferable that the wall member is formed with a chamfered face continued to the second face to guide the circulated endless belt into the first face of the belt stretcher.

With the above configurations, the circulated endless belt can be prevented from surmounting the wall member.

It is also preferable that a part of the wall member is abutted against the first roller to define a gap between the first roller and the first face of the belt stretcher at the second nip portion.

Here, it is further preferable that a distance between the first roller and the first face of the belt stretcher at the gap is larger than a thickness dimension of the endless belt. The distance is determined such that the first face of the belt stretcher presses the recording medium against the first roller through the endless belt when the recording medium enters the second nip portion.

With the above configurations, since the gap serves as a heat insulation layer during the warm-up operation of the apparatus, a heat quantity absorbed from the first roller (i.e., heat loss) via the endless belt is lessened, so that the time period-required for the warm-up operation can be shortened. When the recording medium enters the second nip portion, the gap is eliminated so that the stable contact between the recording medium and the first roller can be realized.

Preferably, wherein the belt stretcher is pivotable. More preferably, an elastic member urges the belt stretcher toward the first roller. Here, a pivot center of the belt stretcher may be identical with or different from a rotational axis of the second roller.

Preferably, the belt stretcher has a semiannular or circular cross section viewed from the widthwise direction of the endless belt.

In a case where an open side of the semiannular cross section is faced the second roller, the belt stretcher can be disposed as close as possible to the second roller. Therefore, the entire length of the endless belt can be shortened, so that the natural heat release for prolonging the warm-up operation can be suppressed. In addition, the fixing device can be made compact.

Preferably, a cleaner is disposed between the second roller and the belt stretcher so as to abut against an inner peripheral face of the endless belt.

Preferably, the belt stretcher is disposed at an upstream side or a downstream side in the circulating direction of the endless belt relative to the first nip portion.

According to the invention, there is also provided an image forming apparatus, comprising:

an image forming device, which forms a toner image on a recording medium; and the above-described fixing device for fixing the toner image on the recording medium.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will now be described with reference to the accompanying drawings.

Figure 1A:
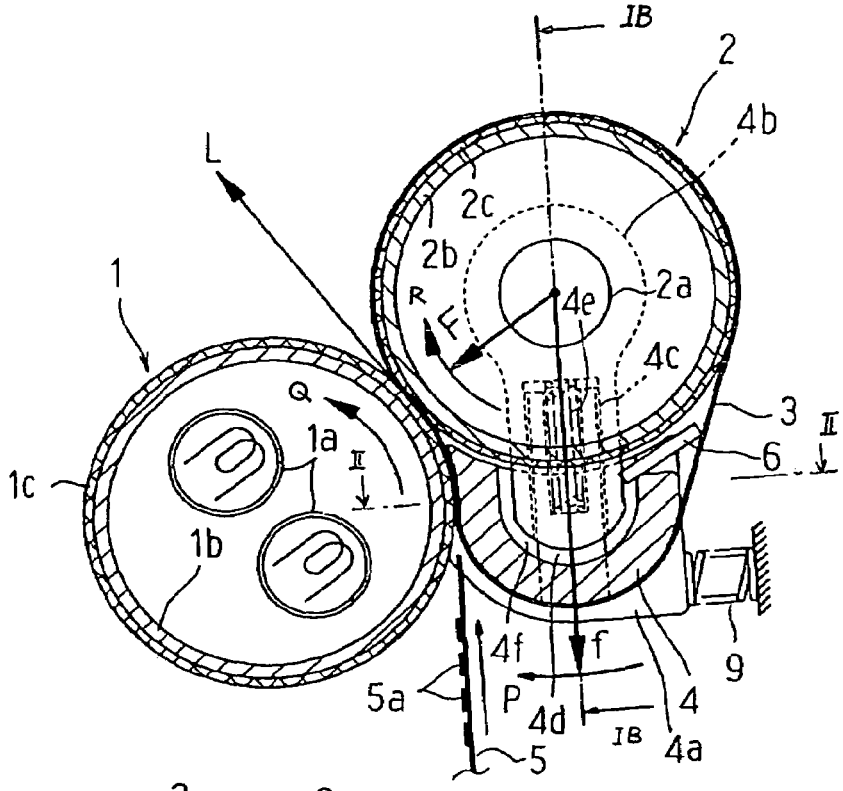
FIG. 1A is a section view of a fixing device according to a first embodiment of the invention.

FIG. 1A shows a fixing device according to a first embodiment of the invention. A heating roller 1 is formed by coating the periphery of a base member 1*b*, which is a pipe member having an outer diameter of about 25 mm and a thickness of about 0.7 mm, with an elastic body 1*c* having a thickness of about 0.4 mm. The heating roller 1 is rotatable in the direction indicated by an arrow Q and includes two column-shaped halogen lamps 1*a* of 1050 W in the interior of the base member 1*b* as a heat source. A pressing roller 2 is formed by coating the periphery of a base member 2*b*, which is a pipe member having an outer diameter of about 25 mm and a thickness of about 0.7 mm, with the elastic body 2*c* having a thickness of about 0.2 mm. The pressing roller 2 is configured to achieve a press-contact force F between the heating roller 1 and the pressing roller 2 at 10 kg or below and the nip length of about 10 mm, and is rotatable in the direction indicated by an arrow R.

A heat-resistant belt 3 (hereinafter, simply referred as "belt") is an endless belt made movable by being nipped between the heating roller 1 and the pressing roller 2 and stretched over the pressing roller 2 and a belt stretcher 4 along their peripheries. The belt 3 is formed from a metal tube, such as a stainless tube and a nickel electrocast tube, or a tube of heat-resistant resin, such as polyimide and silicon, having a thickness of 0.03 mm or greater.

According to this embodiment, because the outer diameters of the heating roller 1 and the pressing roller 2 are set to a diameter as small as 25 mm, a sheet medium 5 having been subjected to the fixing operation winds around neither the heating roller 1 nor the belt 3, which eliminates the need for a member for forcedly separating the sheet medium 5. Also, the rigidity is enhanced by providing a PFA layer of about 30-μm-thick on the surface layer of the elastic body 1*c* on the heating roller 1. Although the elastic bodies 1*c* and 2*c* differ in thickness, they undergo elastic deformation almost identically, and a so-called flat nip is formed. Hence, no difference is generated in transportation speed of the belt 3 or a sheet medium 5 with respect to the peripheral speed of the heating roller 1, which enables an image to be fixed in an extremely stable manner.

In this embodiment, two heat sources 1*a* are built into the heating roller 1 such that the halogen lamps are placed in the different positions to be selectively activated, it becomes easier to control temperatures under different positions or conditions, that is, between a portion where the belt 3 winds around the heating roller 1 and a portion where the belt stretcher 4 comes in sliding contact with the heating roller 1, and between a wide sheet medium and a narrow sheet medium.

The belt stretcher 4 is provided upstream of the nip portion between the heating roller 1 and the pressing roller 2 in the transportation direction of the sheet medium 5, and is provided to be able to pivot in a direction indicated by an arrow P about the rotary shaft 2*a* of the pressing roller 2. The belt stretcher 4 is configured in such a manner that the belt 3 is stretched over in the tangential direction to the heating roller 1 while no sheet medium 5 is passing through the nip portion. When a fixing pressure is too large at the position from which a sheet medium 5 starts to enter the nip portion, the sheet medium 5 is not able to enter the nip portion smoothly, and the fixing may be performed while the leading end of the sheet medium 5 being folded. However, by configuring the belt 3 to be stretched over in the tangential direction to the heating roller 1, it is possible to form an entrance portion through which a sheet medium 5 is able to enter the nip portion smoothly and stably.

The belt stretcher 4 is a semiannular member which is disposed in an inner periphery of the heat-resistant so as to provide a tensile force f to the belt in cooperation with the pressing roller 2. Accordingly, the belt 3 slides on the semiannular member. The belt stretcher 4 is provided at a position where a nip is formed by bringing the belt 3 into press contact with the heating roller 1 beyond a tangential line L of the press contact portion between the heating roller 1 and the pressing roller 2.

A protruding wall 4*a* is formed to protrude from one end or both ends of the belt stretcher 4, and regulates the leaning when the belt 3 leans to one side as it abuts on the protruding wall 4*a*. A spring 9 is provided in a space between the frame and the end face of the protruding wall 4*a* on the opposite side of the heating roller 1. The belt stretcher 4 is thereby slightly pressed against the heating roller 1 by the spring 9 and is positioned such that the belt 3 comes in sliding contact with the heating roller 1.

In order to drive the pressing roller 2 in a stable manner by stretching the belt 3 over the pressing roller 2 and the belt stretcher 4, it is preferable to set a frictional coefficient between the pressing roller 2 and the belt 3 larger than a frictional coefficient between the belt stretcher 4 and the belt 3. The frictional coefficient, however, may become unstable due to intrusion of foreign substances or abrasion. In contrast, by setting a winding angle of the belt 3 to the pressing roller 2 smaller than a winding angle of the belt 3 to the belt stretcher 4, and by setting the diameter of the belt stretcher 4 smaller than the diameter of the pressing roller 2, it is possible to shorten a distance over which the belt 3 slides on the belt stretcher 4. Destabilizing factors derived from a change with time or disturbances can be thus avoided, which in turn makes it possible to drive the belt 3 in a stable manner by the pressing roller 2.

A cleaner 6 is provided somewhere between the pressing roller 2 and the belt stretcher 4 to come in sliding contact with the inner peripheral surface of the belt 3, and thereby cleans the foreign substances, abrasive powder, etc. on the inner peripheral surface of the belt 3. By cleaning the foreign substances, abrasive powder, etc., the belt 3 is refreshed and destabilizing factors are thereby removed. In addition, a concave portion 4*f* provided in the belt stretcher 4 is suitable to store the removed foreign substances, abrasive powder, etc.

A nip entrance is defined as a position at which the belt stretcher 4 is slightly pressed against the heating roller 1, and a nip exit is defined as a position at which the pressing roller 2 is pressed against the heating roller 1. A sheet medium 5 enters from the nip entrance and passes a space between the belt 3 and the heating roller 1 so that an unfixed toner image 5*a* is fixed on the sheet medium 5. The sheet medium 5 is then discharged from the nip exit in the direction of the tangential line L.

Figure 1B:
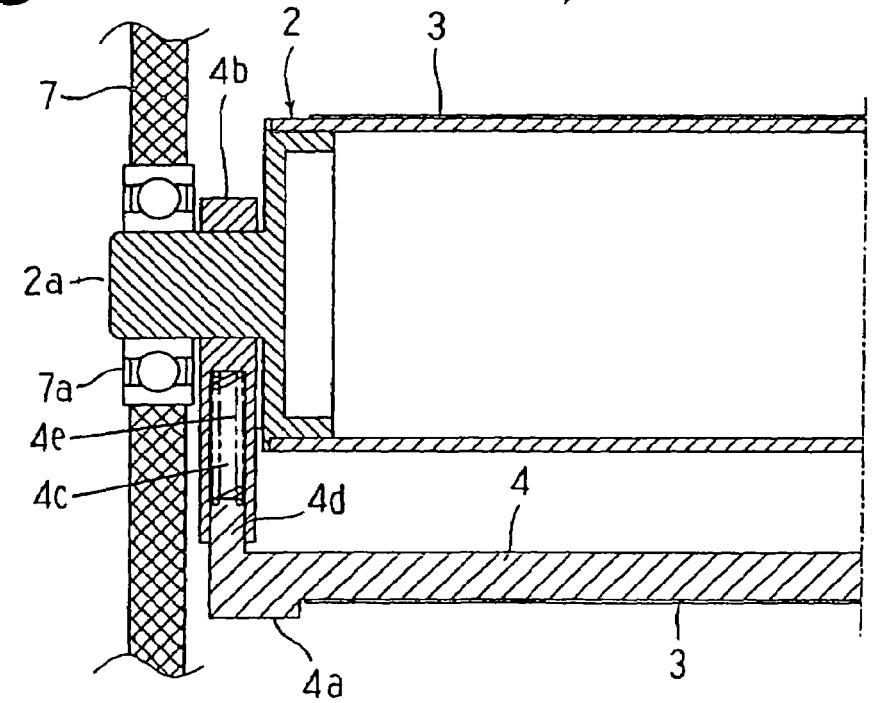
FIG. 1B is a partial section view taken along a line IB—IB of FIG. 1A.

A supporting structure of the pressing roller 2 and the belt stretcher 4 will now be described. The both ends of rotary shaft 2*a* of the pressing roller 2 are, as is shown in FIG. 1B, supported by frames 7 on the right and left via bearings 7*a* to be free to rotate (the right side is omitted from the drawing). On the both sides of the rotary shaft 2*a* of the pressing roller 2 are fitted arms 4*b* to be free to pivot, and a guiding groove 4*c* is formed in each arm 4*b* so as to face the belt stretcher 4. On the other hand, at the both ends of the belt stretcher 4 are formed guiding portions 4*d* to be fitted into the guiding grooves 4*c* in the arms 4*b* via springs 4*e*. The belt stretcher 4 is therefore of a structure such that provides the tensile force f to the belt 3 as it is pushed by the springs 4*e* in a direction to move away from the pressing roller 2.

In this embodiment, the belt stretcher 4 is used as a non-rotating member for the belt 3 to slide thereon, a bearing or the like is not necessary, which can make the supporting structure simpler. In addition, by forming the belt stretcher 4 in a semiannular shape, it is possible provide the belt stretcher 4 in the closest proximity to the pressing roller 2 by facing the missing half of the ring toward the pressing roller 2. This also makes it possible to form the belt 3 with a shorter peripheral length. It is thus possible to provide a compact, inexpensive heating roller type fixing device by simplifying the structure.

Also, because the belt 3 moves along a path of the least necessary length, for the belt 3 heated at the nip portion with the heating roller 1 housing the heat source, heat energy absorbed while moving along a predetermined path can be minimized. Also, because the peripheral length is short, a drop in temperature due to natural heat release is small, which makes it possible to shorten a so-called warm-up time needed to reach a desired temperature for the fixing to be enabled since the apparatus has been activated.

Also, because the belt 3 is brought into press contact with the heating roller 1 to form the nip portion with the tensile force f provided from the belt stretcher 4 in cooperation with the pressing roller 2, the nip length can be readily extended and the structure can be simplified, which in turn makes the device compact and less expensive.

In order to fix an unfixed toner image 5*a* formed on a sheet medium 5 in a stable manner, it is essential to melt the unfixed toner image 5*a* sufficiently before it is fixed, and predetermined temperature and melting time are needed. In this embodiment, since there is no need to provide a member for extending the nip length by causing the elastic body 1*c* of the heating roller 1 to undergo considerable deformation, the thickness of the elastic body 1*c* can be made thin. In addition, since there is no need to set a large press-contact pressure to the pressing roller 2 in causing the elastic body to undergo deformation. Hence, only a small stress is applied to the sheet medium 5 bearing the unfixed toner image 5*a* when it passes through the space between the heating roller 1 and the belt 3, which suppresses the sheet medium distortion, such as the occurrence of wrinkles, when the sheet medium 5 is discharged after the unfixed toner image 5*a* is fixed thereon.

Thus, not only can the need to increase the mechanical rigidity of the heating roller type fixing device be eliminated, but also the heating roller 1 can be thinner. It is thus possible to increase the heating speed with which the heat source heats the belt 3. The pressing roller 2 can be thinner, too, and a heat capacity can be smaller, which can reduce absorption of heat energy from the belt 3. It is thus possible to shorten the warm-up time.

Figure 2:
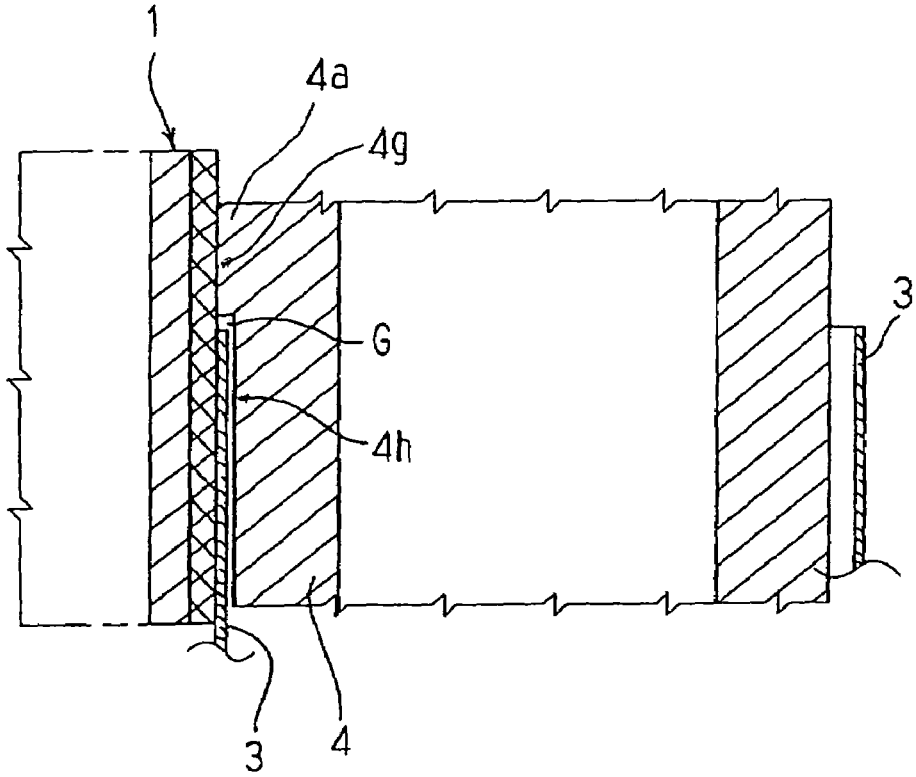
FIG. 2 is a partial section view taken along a line II—II of FIG. 1A.
Figure 3:
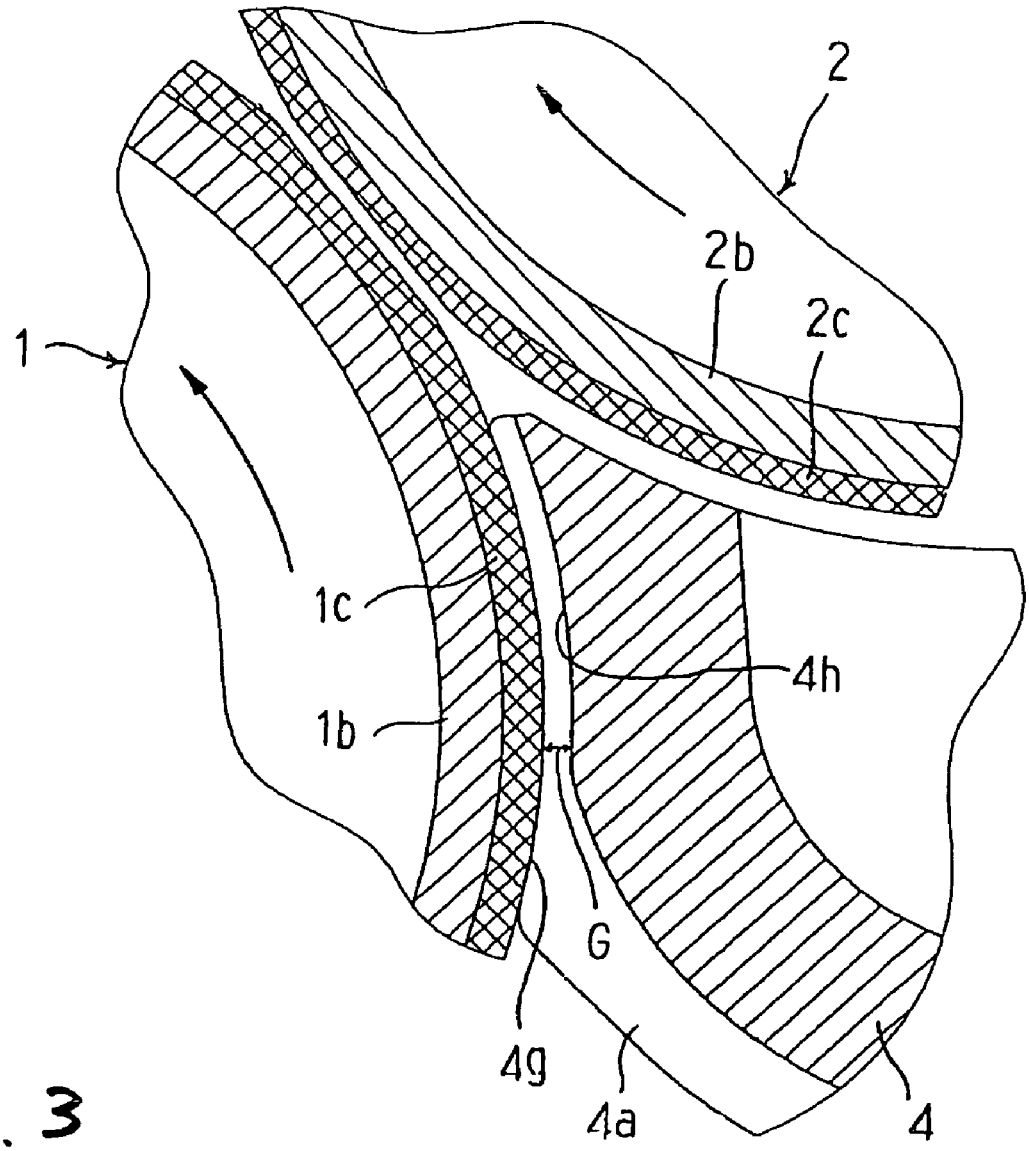
FIG. 3 is a partial section view of a press contact portion of a belt stretcher and a heating roller in the fixing device of FIG. 1A, showing a state that a heat-resistant belt is removed.

As shown in FIGS. 2 and 3, the protruding wall 4*a* of the belt stretcher 4 is positioned by coming in sliding contact with the heating roller 1 on a slide-contact surface 4*g*. A gap (step difference) G, which is larger than the thickness of the belt 3, is provided to the belt stretcher 4 between the slide-contact surface 4*g* and a pressing surface 4*h* that presses the belt 3 and thereby presses a sheet medium 5 against the heating roller 1. The pressing surface 4*h* is formed concentrically with the heating roller 1. To be more concrete, by forming the gap G from a step difference of about 110 μm, and forming the belt 3 to have a thickness of about 80 μm, a clearance of about 30 μm is secured, which enables the fixing to be performed in a stable manner even for a sheet medium 5 as thick as 60 μm.

Figure 4:
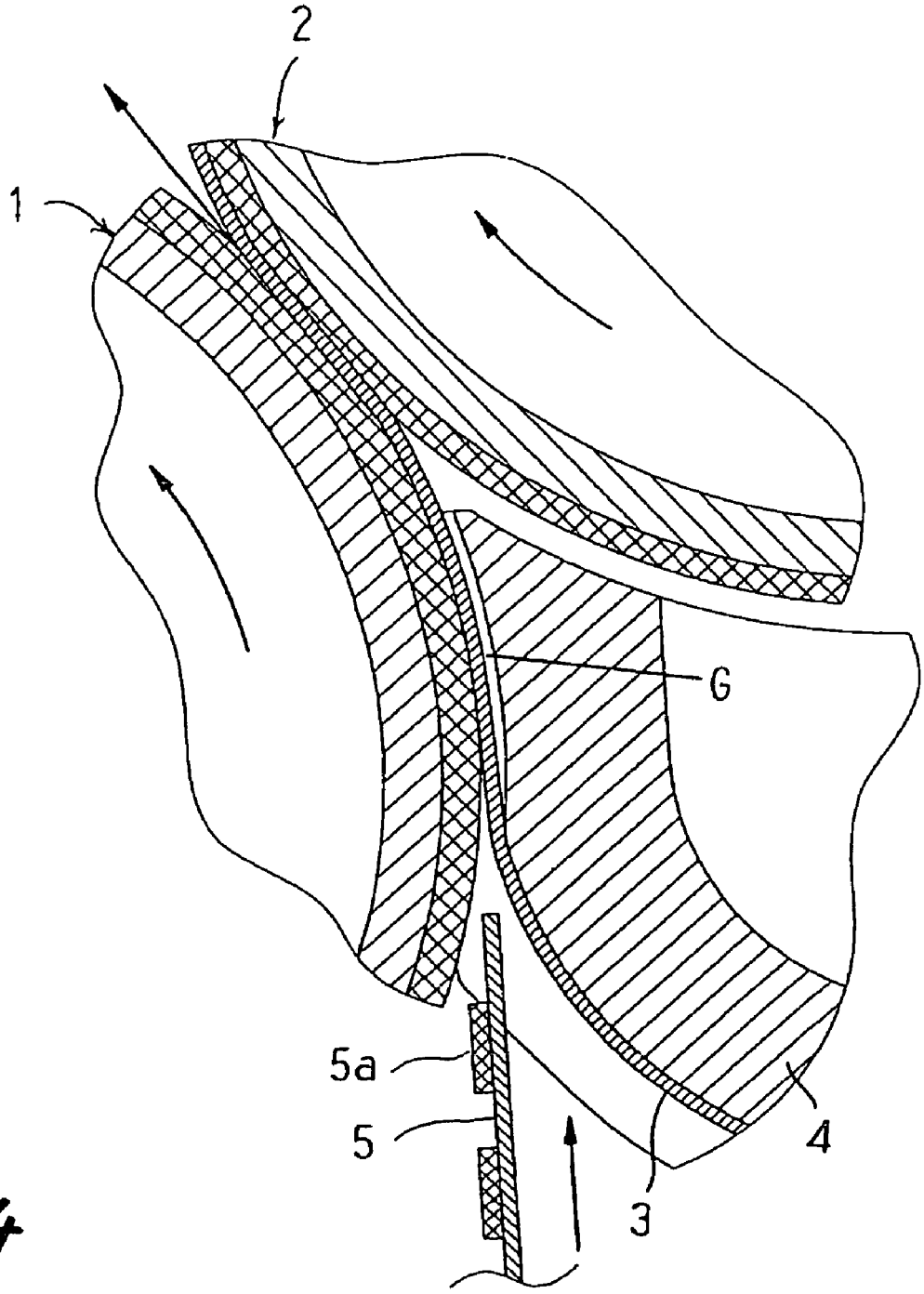
FIG. 4 is a partial section view of the press contact portion, showing a state that the heat-resistant belt is attached.

As shown in FIG. 4, the belt 3 is nipped between the heating roller 1 and the pressing roller 2, and is brought into press contact with the heating roller by the belt stretcher 4 so as to define the nip entrance.

In is not practical to bring a speed in the process step of forming an unfixed toner image 5*a* on a sheet medium 5, which is the preceding step of the fixing step, into perfect agreement with a speed in the fixing step, when irregularities in specifications of various mass-produced components are concerned. Hence, speeds in the consecutive steps are balanced by setting the speed in the fixing step to one side, that is, either reduced or increased from the speed in the process step of forming an unfixed toner image 5*a* on a sheet medium 5 in consideration of such irregularities. Although there is a need to specify an entering speed of a sheet medium 5 by gripping the sheet medium 5 in a reliable manner at the nip entrance, the need can be satisfied by the configuration described above.

In addition, the surface of the elastic body 1*c* of the heating roller 1 and the surface of the belt 3 move at the same peripheral speed to fix an unfixed toner image 5*a* formed on a sheet medium 5. However, when the surface of the belt 3 is corrugated or the leading end of the sheet medium 5 is corrugated, the initial condition of the fixing operation may become unstable. Hence, by configuring the belt 3 in such a manner that it is pressed against the heating roller 1 at the nip entrance, the both components are able to meet in a stable condition, which enables the unfixed toner image 5*a* to be fixed in an extremely stable manner.

In this embodiment, in the foregoing state while no sheet medium 5 is passing through, the gap G is formed between the belt 3 and the belt stretcher 4. Hence, the clearance in the gap G serves as a heat insulation layer during the warm-up. A heat quantity absorbed from the heating roller 1 via the belt 3 is thus lessened, and so is a heat loss. The warm-up time, therefore, can be shortened.

Figure 5:
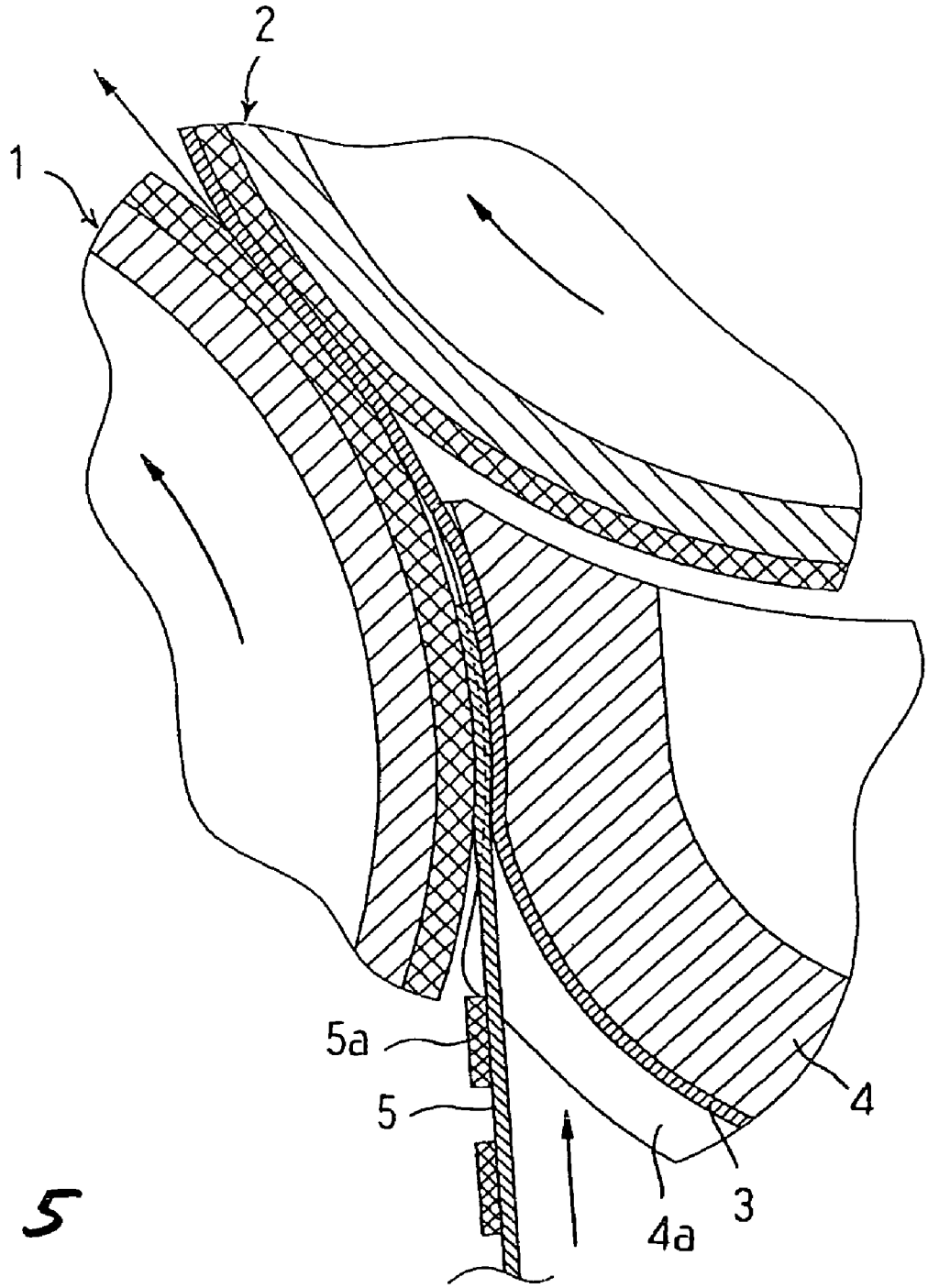
FIG. 5 is a partial section view of the press contact portion, showing a state that a sheet medium enters the press contact portion.

On the other hand, when a sheet medium 5 is passing through the nip portion, as is shown in FIG. 5, the protruding wall 4*a* of the belt stretcher 4 is kept spaced apart from the heating roller 1, which eliminates the gap G between the belt 3 and the belt stretcher 4. The sheet medium 5 is thus pressed by the belt 3 at the nip portion, and hence pressed against the heating roller 1, which makes it possible to achieve adequate fixing by adjusting this pressing pressure to a desired pressure with the use of the spring 9 shown in FIG. 1A.

Also, a heat quantity, accumulated while the belt stretcher 4 is heated by the heating roller 1, is small due to the presence of the gap G. Hence, when the sheet medium 5 enters the nip portion, the second surface of the sheet medium 5 opposite to the first surface on which the unfixed toner image 5*a* is formed cools the belt 3 having a small heat capacity. Since a heat quantity supplied from the belt stretcher 4 side is small, in a case of double-sided image fixing to fix an unfixed toner image 5*a* on the second surface after the unfixed toner image 5*a* formed on the first surface of the sheet medium 5 is fixed, the image fixed earlier on the first surface is not excessively heated when the second surface undergoes fixing, and no disturbance occurs in the image fixed on the first surface.

In this embodiment, as is shown in FIG. 1A, the spring 9 is provided upstream of the press contact portion between the heating roller 1 and the pressing roller 2 in the moving direction of the belt 3, at a position remote from the pivot center of the belt stretcher 4. The belt 3 is driven by driving one of the heating-roller 1 and the pressing roller 2, and the belt stretcher 4 starts to pivot toward the heating roller 1 by this driving force and the sliding-frictional force between the belt 3 and the belt stretcher 4. However, there may be a case where the pivotal moving force alone cannot induce a sufficient fixing pressure to fix an unfixed toner image 5*a* formed on a sheet medium 5. To address this inconvenience, the pivotal moving force is set to a desired fixing pressure with the assistance of the spring 9, so that the unfixed toner image 5*a* can be fixed in an extremely stable manner.

It is preferable that the tensile force f, applied to the belt 3 from the belt stretcher 4 in cooperation with the pressing roller 2, is identical across the entire stretched region. However, in some cases, the accuracy of straightness of the pressing roller 2 and the belt stretcher 4, or the accuracy of homogeneity of the inner periphery of the belt 3, or an erroneous factor of a quantity of deformation occurred while the tensile force is applied to the pressing roller 2 and the belt stretcher 4, makes it difficult to make the tensile force f identical across the entire stretched region.

Figure 6A:
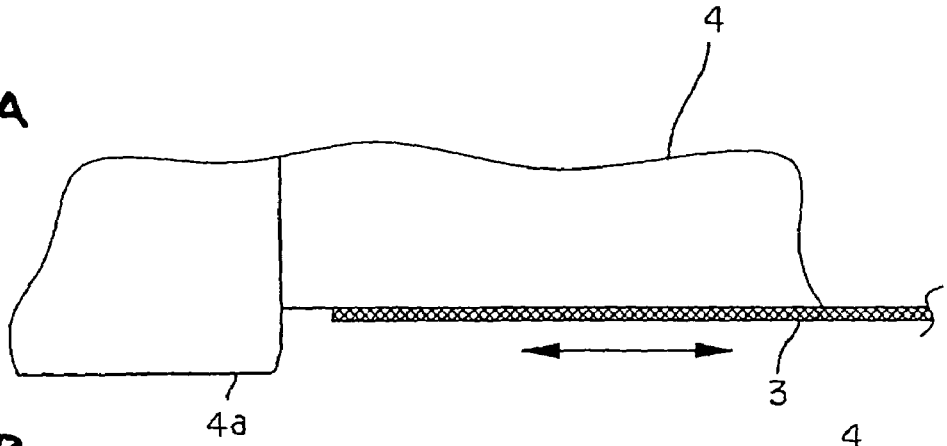
FIG. 6A is an enlarged schematic view for explaining the movement of the belt sliding on the belt stretcher.

In addition, besides the foregoing state, as is shown in FIG. 6A, the belt 3 runs with wobbling due to the factors, such as the accuracy of parallelism in the pressing roller 2 and the belt stretcher 4 provided at their respective positions, and the larger the frictional force between the inner surface of the belt 3 and the pressing roller 2 as well as the belt stretcher 4, the larger the wobble-leaning force becomes, which makes it difficult to regulate the running position.

The condition to achieve the position regulation in preventing the wobbling of the belt 3 is to provide a position regulator well capable of responding to the wobble-leaning force of the belt 3 and to have a sufficient withstanding strength while the position of the belt 3 is regulated by the position regulator. Hence, it is crucial whether the belt 3 can secure the withstanding strength.

As is shown in FIG. 1B, by forming the belt stretcher 4 to be supported at the both ends with the springs 4*e* in providing the tensile force f to the belt 3 at least at the side edges of the belt 3 in the width direction, and to have the protruding wall 4*a* that protrudes from each tension applying portion and regulates the side edge face of the belt 3, the belt 3 is brought into a close contact state to the tension applying portion while running along the protruding wall 4*a*.

Figure 6B:
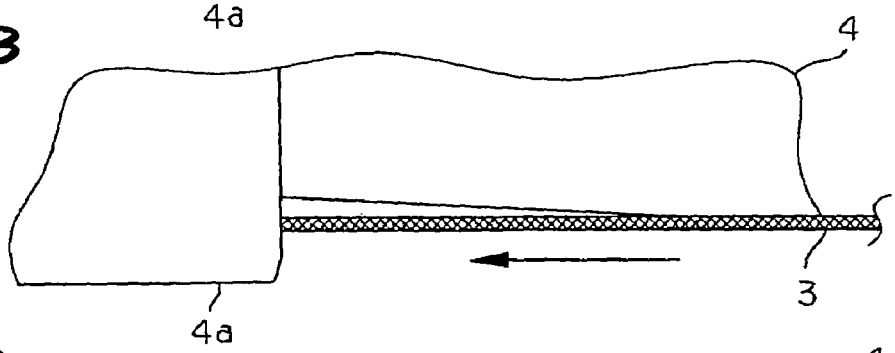
FIGS. 6B and 6C are enlarged schematic views of a belt stretcher according to a first comparative example, showing a case that buckling occurs at the side edge of the belt.
Figure 6C:
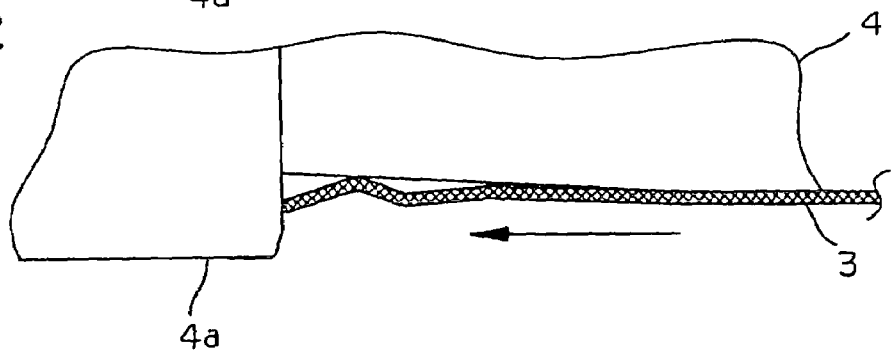

For example, assume that, as is shown in FIG. 6B, a concave, a step difference, a clearance or the like is present in the vicinity of the side edge of the belt stretcher 4 provided with the protruding wall 4*a*. Then, the belt 3 is not able to come in close contact to the sliding surface of the belt stretcher 4, and a clearance is formed. Under these conditions, when the belt 3 runs with wobbling and abuts on the protruding wall 4*a*, a larger wobble-leaning force is exerted, upon which, as is shown in FIG. 6C, the bucking occurs at the side edge of the belt 3.

Figure 7A:
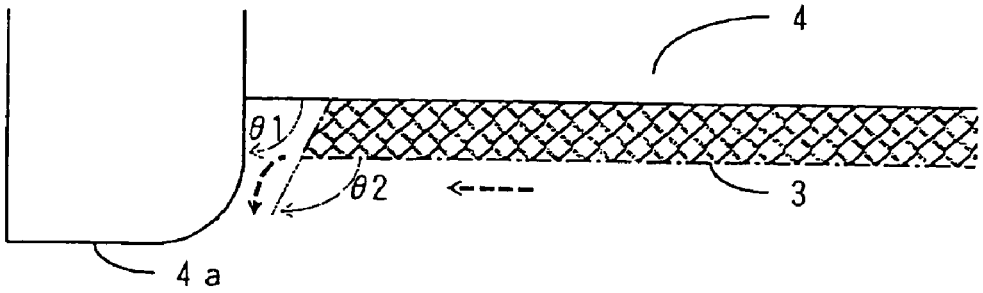
FIG. 7A is an enlarged schematic views of a belt stretcher and a belt according to a second comparative example.
Figure 7B:
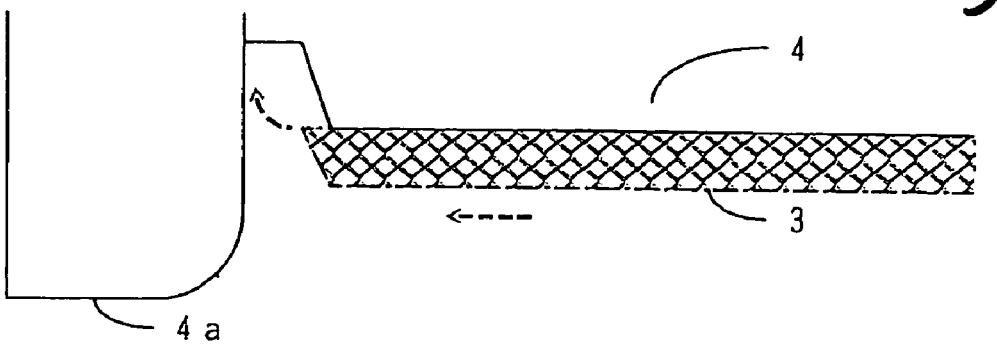
FIG. 7B is an enlarged schematic views of a belt stretcher and a belt according to a third comparative example.

When the inclined angle at the side edge face of the belt 3 and the extending angle of the protruding wall 4*a* relative to the sliding surface of the belt stretcher 4 are concerned, as is shown in FIG. 7A, in a case where the inclined angle θ2 of the side edge face of the belt 3 becomes larger than the extending angle θ1 of the protruding wall 4*a*, if the belt 3 runs with wobbling and abuts on the protruding wall 4*a*, a large wobble-leaning force is exerted, upon which the side edge of the belt 3 is lifted along the protruding wall 4*a* as indicated. On the other hand, as is shown in FIG. 7B, in a case where the angle θ2 at the side edge face of the belt 3 is smaller than the extending angle θ1 of the protruding wall 4a and a clearance is formed between the sliding surface of the belt stretcher 4 and the protruding wall 4*a*, if the belt 3 runs with wobbling and abuts on the protruding wall 4*a*, a large wobble-leaning force is exerted, upon which the side edge of the belt 3 engages in the clearance portion along the protruding wall 4*a*, thereby giving rise to the bucking at the side edge of the belt 3.

Figure 8A:
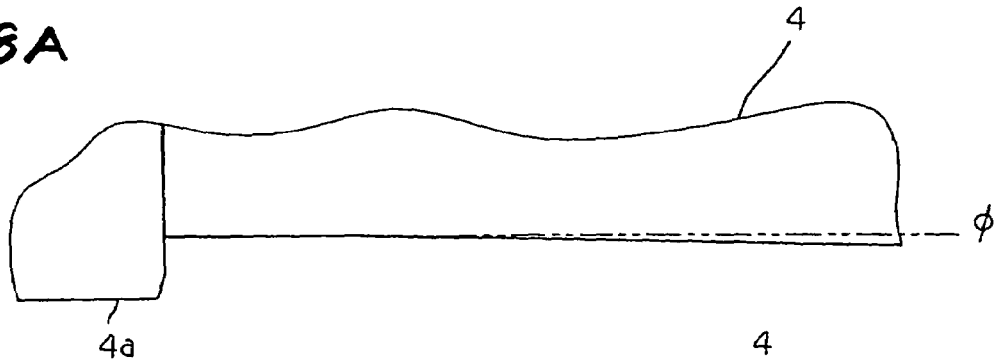
FIGS. 8A and 8B are enlarged schematic views of the shapes of the belt stretcher in the fixing device of FIG. 1A.
Figure 8B:
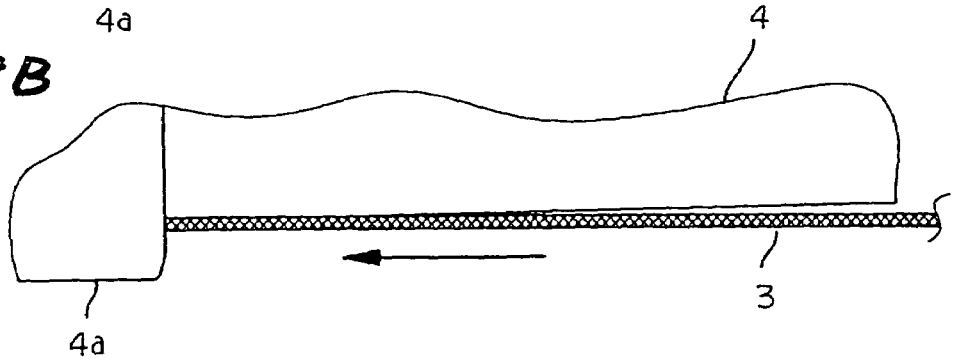

In order to prevent the occurrence of bucking at the side edge of the belt 3, as is shown in FIG. 8B, the belt 3 needs to come in close contact to the sliding surface of the belt stretcher 4 without any clearance at the side edge region of the belt 3, and the protruding wall 4*a* needs to have a wall surface that rises continuously from the sliding surface. The protruding wall 4*a* is preferably provided as a monolithic part of the belt stretcher 4. Even when the protruding wall 4*a* is an individual member from the belt stretcher 4, it is preferable that the protruding wall 4*a* is provided integrally with the belt stretcher 4, so that the belt 3 slides on the sliding surface of the belt stretcher 4 in close contact without leaving any clearance. To this end, it is also preferable to support the belt stretcher 4 at the both ends with the use of the springs 4*e*, so that when the belt 3 is stretched over, as is shown in FIG. 1B, the belt stretcher 4 is preferably shaped into an inversed crown shape in which the sliding surface is concave from the both ends to the center portion.

In view of the foregoing, the side edge of the belt 3 abuts on the protruding wall 4*a* while coming close contact with the sliding surface of the belt stretcher 4, so that the wobbling of the belt 3 can be regulated effectively and the position regulation of the belt 3 to be performed in a stable manner. In this case, the belt 3 is supported by the belt stretcher 4 at the both side edge regions thereof, thereby generating a bent at the center portion thereof. In view of this, as shown in FIG. 8A, the sliding surface of the belt stretcher 4 may be shaped into a crown shape in which the sliding surface is convex from the both ends to the center portion, under the condition that the side edge regions of the belt 3 are brought into close contact with the sliding surface of the belt stretcher 4 (along the reference line $\phi$).

Figure 8C:
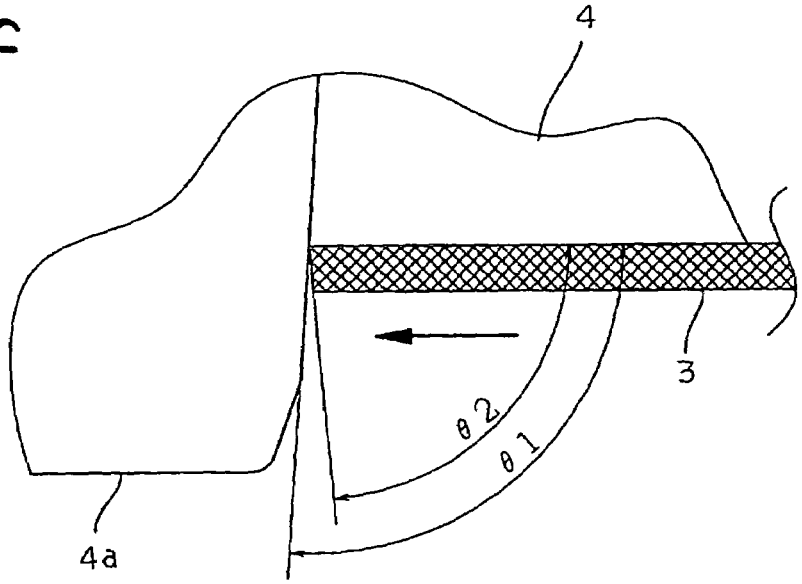
FIG. 8C is an enlarged schematic view of a side edge face of the belt and a protruding wall of the belt stretcher in the fixing device of FIG. 1A.

Further, in order to prevent the bucking at the side edge of the belt 3, as is shown in FIG. 8C, it is preferable to make the inclined angle $\theta 2$ of the side edge face of the belt 3 less than the extending angle $\theta 1$ of the protruding wall 4*a* relative to the sliding surface of the belt stretcher (the reference line $\phi$), that is, to set as $\theta 2 \leqq \theta 1$.

As a structure such that applies a tensile force f to the belt 3 from the belt stretcher 4 in cooperation with the pressing roller 2, by forming the protruding wall 4*a* on either the pressing roller 2 or the belt stretcher 4 side, the wobbling side edge of the belt 3 abuts on the protruding wall 4*a*, thereby the wobbling regulation is performed. However, in a case where the protruding wall 4*a* is provided on the pressing roller 2, it is necessary to provide a structure for receiving the protruding wall 4*a* on the heating roller 1 which is brought into press contact with the pressing roller 2. Such a provision may be a limitation or a restriction to the design of the heating roller 1. In a case where the protruding wall 4*a* is provided in the belt stretcher 4 as in this embodiment, the heating roller can be made free from such a design limitation.

Figure 9A:
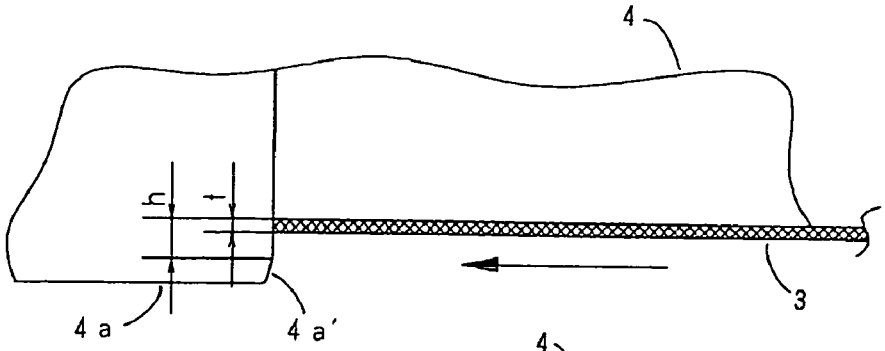
FIG. 9A is an enlarged schematic view showing a relationship between the thickness of the belt and the height of the protruding wall.
Figure 9B:
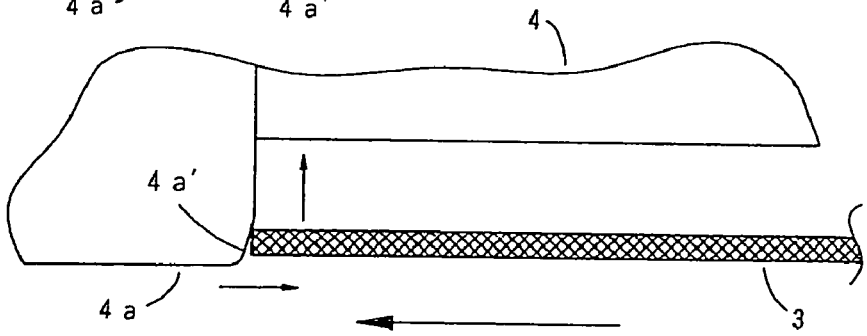
FIG. 9B is an enlarged schematic view showing a function of a chamfered portion formed on the protruding wall.
Figure 9C:
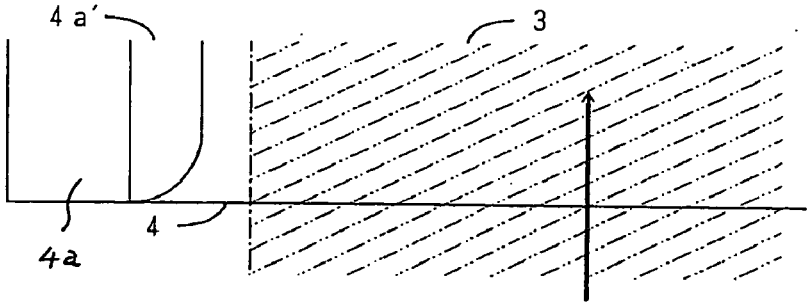
FIG. 9C is a plan view of the belt and the protruding wall viewed from the lower side of FIG. 9B.

Also, the belt 3 closely adheres to the belt stretcher 4 and runs with sliding due to the tensile force f, at the portion where it abuts on the protruding wall 4*a* and the position regulation on the running with wobbling is thereby effected. When the tensile force f is greater than the running force with wobbling, there may occur a phenomenon that the side edge of the belt 3 surmounts the protruding wall 4*a* or the end face of the belt 3 extends to overlap a part of the protruding wall 4*a*. In order to avoid such phenomena while increasing the degree of the design freedom, such as the edge strength of the belt 3, the tensile force f, the running force with wobbling of the belt 3, it is preferable to form the protruding wall 4*a*, as is shown in FIG. 9A, to have a belt regulating height h at least twice the thickness t of the belt 3.

When the belt 3 is brought into close contact with the sliding surface of the belt stretcher 4, the belt 3 tends to wobble. Therefore, it is necessary to provide a structure for smoothly subjecting the belt 3 having been separated from the pressing roller 2 to the wobbling regulation by the protruding wall 4*a* of the belt stretcher 4. In this embodiment, as shown in FIGS. 9B, 9C, 10A and 10B, a chamfered portion 4*a*' is formed along an inner top edge of the protruding wall 4*a*' to smoothly introduce the belt 3 to the region where the protruding wall 4*a* is formed. As shown in FIG. 9A, the belt regulating height h is defined so as to exclude the chamfered portion 4*a*'.

Figure 9D:
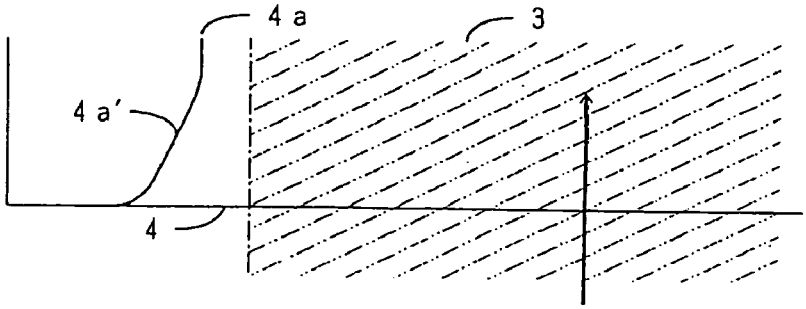
FIG. 9D is a plan view of a modified example of the protruding wall of FIG. 9C.
Figure 10A:
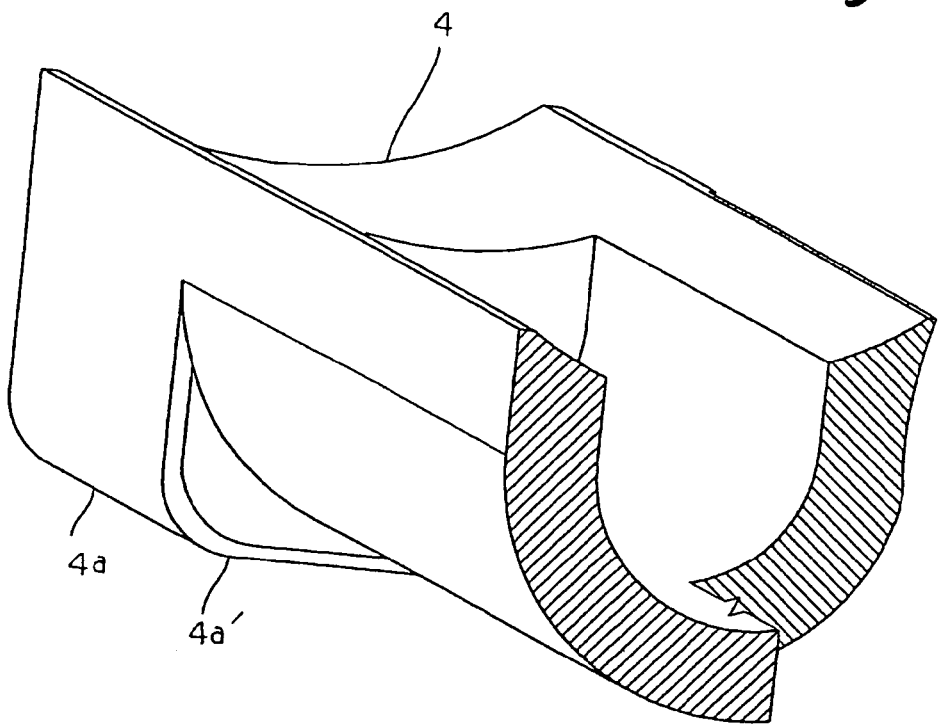
FIG. 10A is a perspective view of the protruding wall of FIG. 9B, showing a state that the belt is removed.
Figure 10B:
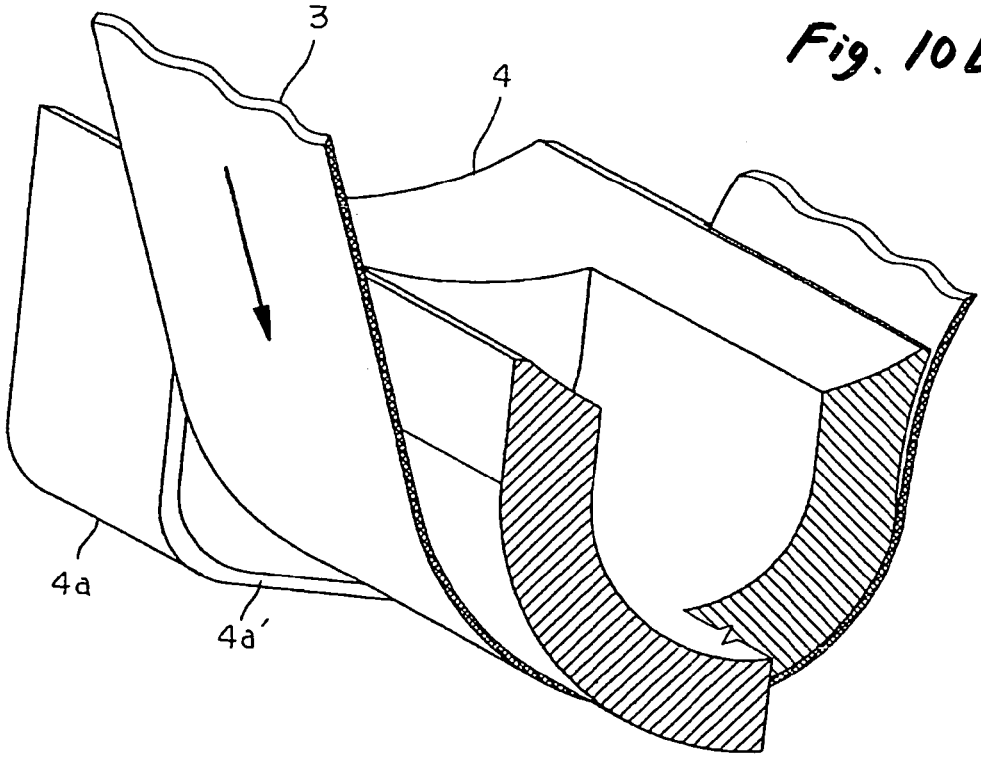
FIG. 10B is a perspective view of the protruding wall of FIG. 9B, showing a state that the belt is attached.

Alternatively, as shown in FIG. 9D, the chamfered portion 4*a*' may be formed at the entrance of the region where the protruding wall 4*a* is formed such that the width of the sliding surface of the belt stretcher 4 is gradually reduced.

In this embodiment, the spring 9 is provided upstream of the press contact portion between the heating roller 1 and the pressing roller 2 in the moving direction of the belt 3, which is remote from the pivot center of the belt stretcher 4. Hence, as is shown in FIG. 11B, it is possible to increase the fixing pressure continuously from the nip entrance toward the press contact portion between the heating roller 1 and the pressing roller 2 due to the mechanism of leverage, and a stress having an inflection point is not applied to a sheet medium 5. Hence, no fixing irregularities or the like are generated in a fixed image, which not only enables an unfixed toner image 5*a* to be fixed in an extremely stable manner, but also the sheet medium distortion, such as the occurrence of wrinkles, can be suppressed for a sheet medium 5 discharged after the unfixed toner image 5*a* is fixed.

Incidentally, "H" denotes the case of a thick sheet medium or a layered sheet medium such as an envelop, having a large heat capacity, or a transparent sheet medium such as an OHP sheet, "S" denotes the case of a standard sheet medium, and "L" denotes a thin sheet medium or a sheet medium having a poor heat resistance.

Figure 11A:
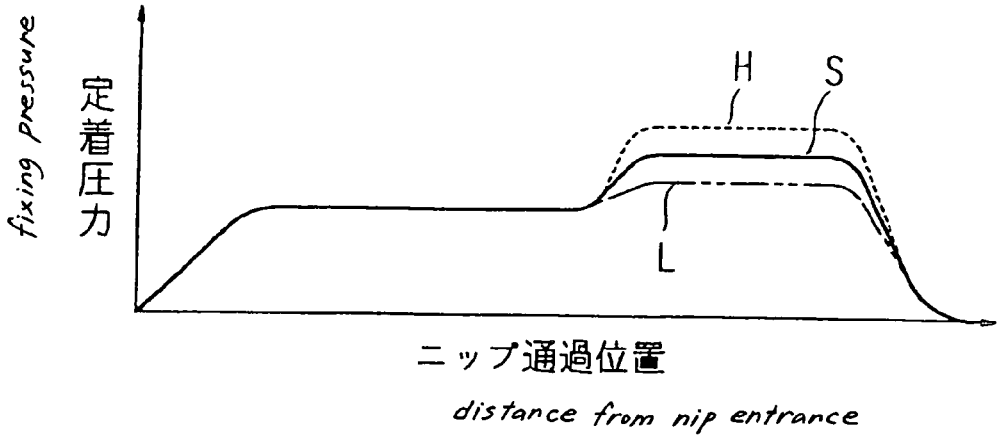
FIG. 11A is a graph showing fixing pressure variation generated by the belt stretcher in a case where a spring for assisting a pivot movement of the belt stretcher is not provided.
Figure 11B:
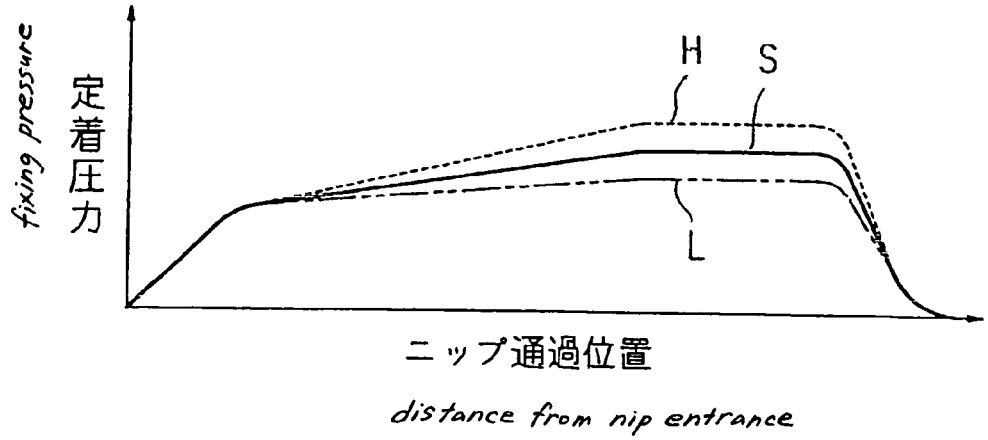
FIG. 11B is a graph showing fixing pressure variation generated by the belt stretcher in a case where the spring for assisting the pivot movement of the belt stretcher is provided.

For the comparison purpose, FIG. 11A shows the pressing pressure variation in a case where the spring 9 is not provided. In other words, it is a case where the fixing pressure is generated only by the pivot movement of the belt stretcher 4 without the assistance of the spring 9.

The fixing pressure (abutting pressure distribution) between the heating roller 1 and the belt 3 reaches the maximum pressure at a portion at which the heating roller 1 and the pressing roller 2 come in pressing contact with each other. In a case where it is difficult to melt an unfixed toner image 5*a* sufficiently to enable the fixing in a stable manner, for example, when the surface of a sheet medium 5 is irregular, or the surface is made of a material having excellent hermeticity and is so smooth that a melted toner image hardly permeates inside like an OHP sheet, by providing a higher pressure than that in the melting stage to melted toner in the final stage where the sheet medium 5 passes through the nip, not only can the surface of the melted toner be smooth, but also the permeation into the sheet medium 5 can be promoted and the fixed image, therefore, can be more stable.

Figure 12A:
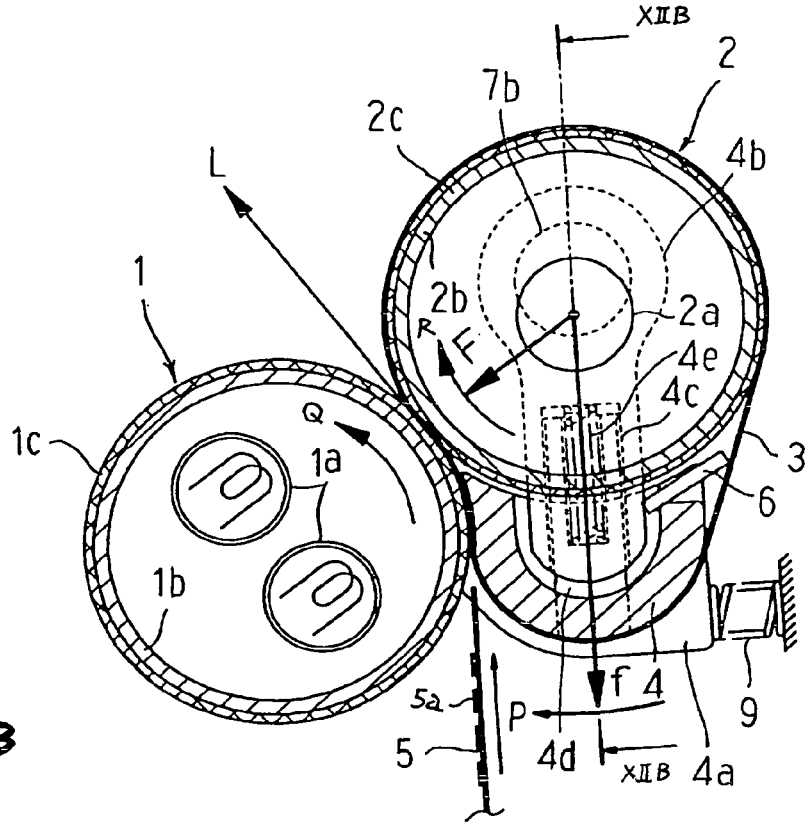
FIG. 12A is a section view of a fixing device according to a second embodiment of the invention.
Figure 12B:
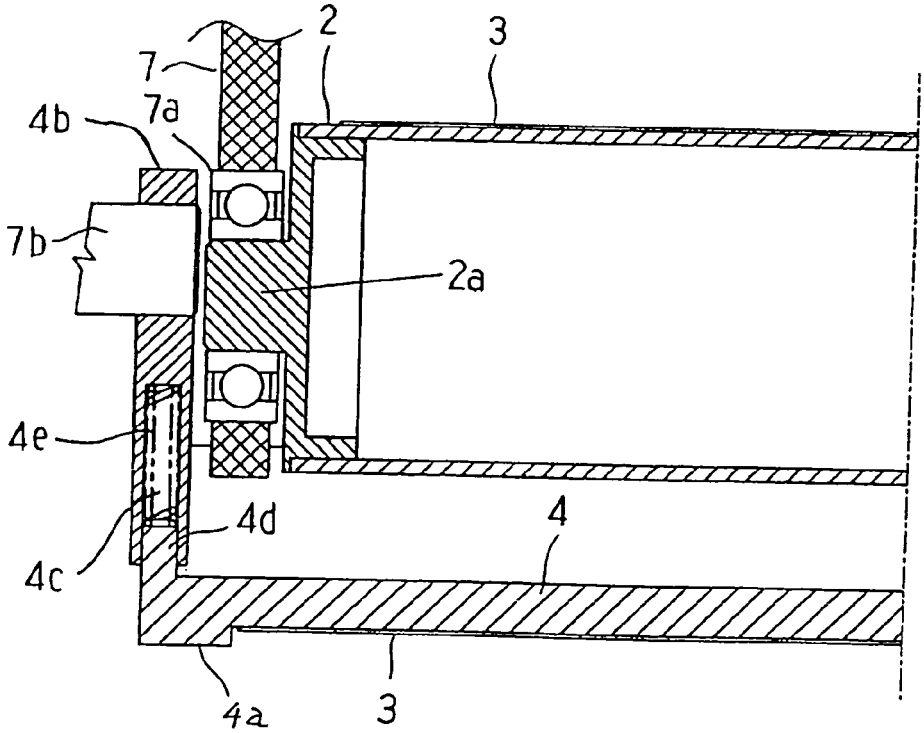
FIG. 12B is a partial section view taken along a line XIIB—XIIB of FIG. 12A.

FIGS. 12A and 12B show a fixing device according to a second embodiment of the invention. Members similar to those in the first embodiment are designated by the same reference numerals and the repetitive explanations for those will be omitted.

In the first embodiment, the belt stretcher 4 is allowed to pivot by a predetermined angle about the common axis with the rotary shaft 2*a* of the pressing roller 2. In this embodiment, the belt stretcher 4 is configured so as to be allowed to pivot by a predetermined angle about an axis 7*b*, which is different from the rotary shaft 2*a* of the pressing roller 2.

In other words, on the both sides of the axis 7*b* provided at a position different from the axial center of the rotary shaft 2*a* are fitted arms 4*b* to be free to pivot, and a guiding groove 4*c* is formed in each arm 4*b* so as to face the belt stretcher 4. On the other hand, at the both ends of the belt stretcher 4 are formed guiding portions 4*d* to be fitted into the guiding grooves 4*c* in the arms 4*b* via springs 4*e*. The belt stretcher 4 is therefore of a structure such that provides a tensile force f to the belt 3 as it is pushed by the springs 4*e* in a direction to move away from the pressing roller 2.

This configuration can change the torque acting on the belt stretcher 4 (in this embodiment, the torque is increased), which makes it possible to adjust the press-contact force between the belt 3 and the heating roller 1 in accordance with the position of the axis 7*b*. Also in this embodiment, as is shown in FIG. 2, a gap (step difference) G, which is larger than the thickness of the belt 3 is provided to the belt stretcher 4 between the slide-contact surface 4*g* and the pressing surface 4*h* that presses the belt 3 to press a sheet medium 5 against the heating roller 1.

Figure 13:
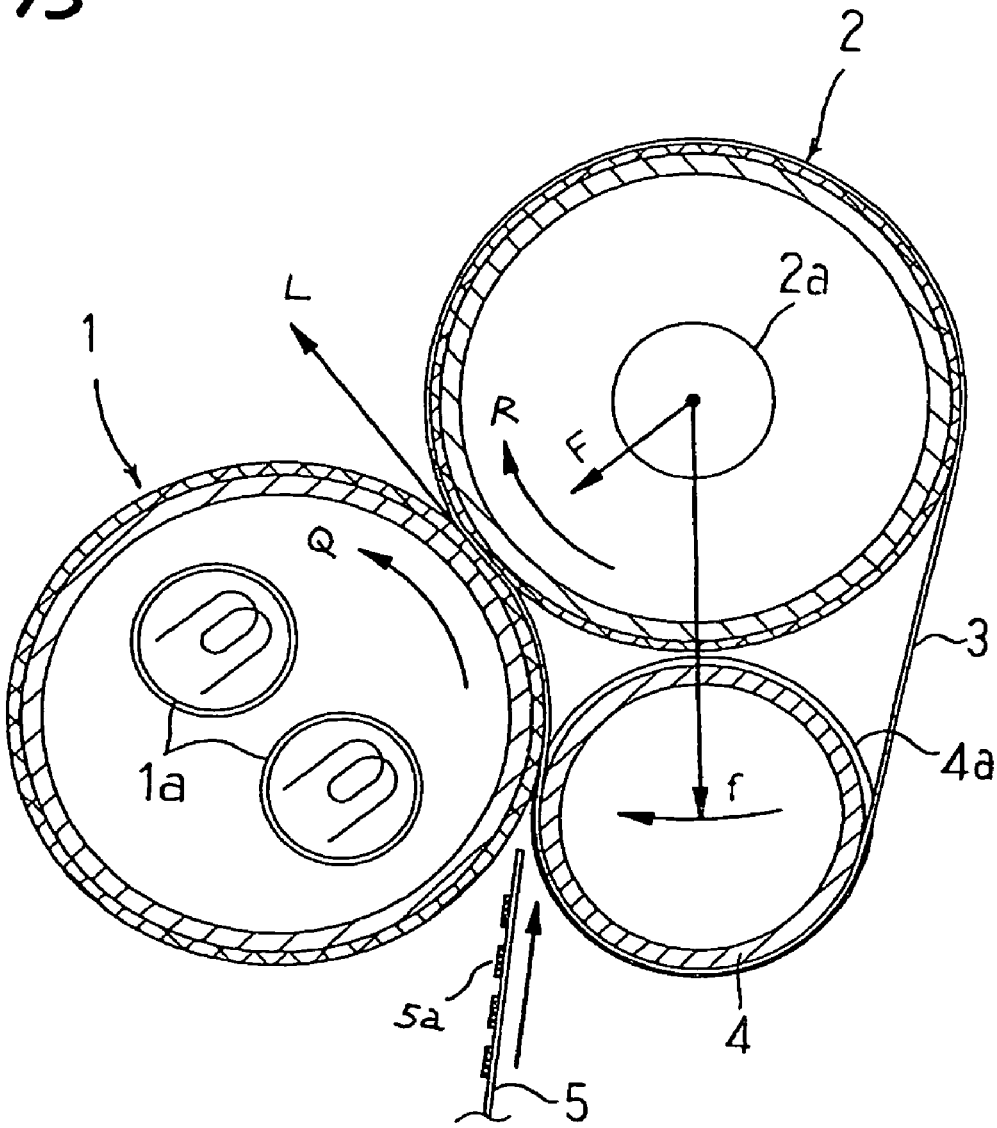
FIG. 13 is a section view of a fixing device according to a third embodiment of the invention.

FIG. 13 shows a fixing device according to a third embodiment of the invention. Members similar to those in the first embodiment are designated by the same reference numerals and the repetitive explanations for those will be omitted.

In this embodiment, the belt stretcher 4 is provided as a non-rotatable cylindrical member. Also in this embodiment, as is shown in FIG. 2, a gap (step difference) G, which is larger than the thickness of the belt 3, is provided to the belt stretcher 4 between the slide-contact surface 4*g* and the pressing surface 4*h* that presses the belt 3 to press the sheet medium 5 against the heating roller 1.

A fourth embodiment of the invention will be described with reference to FIGS. 14A through 17. Members similar to those in the first embodiment are designated by the same reference numerals and the repetitive explanations for those will be omitted.

Figure 14A:
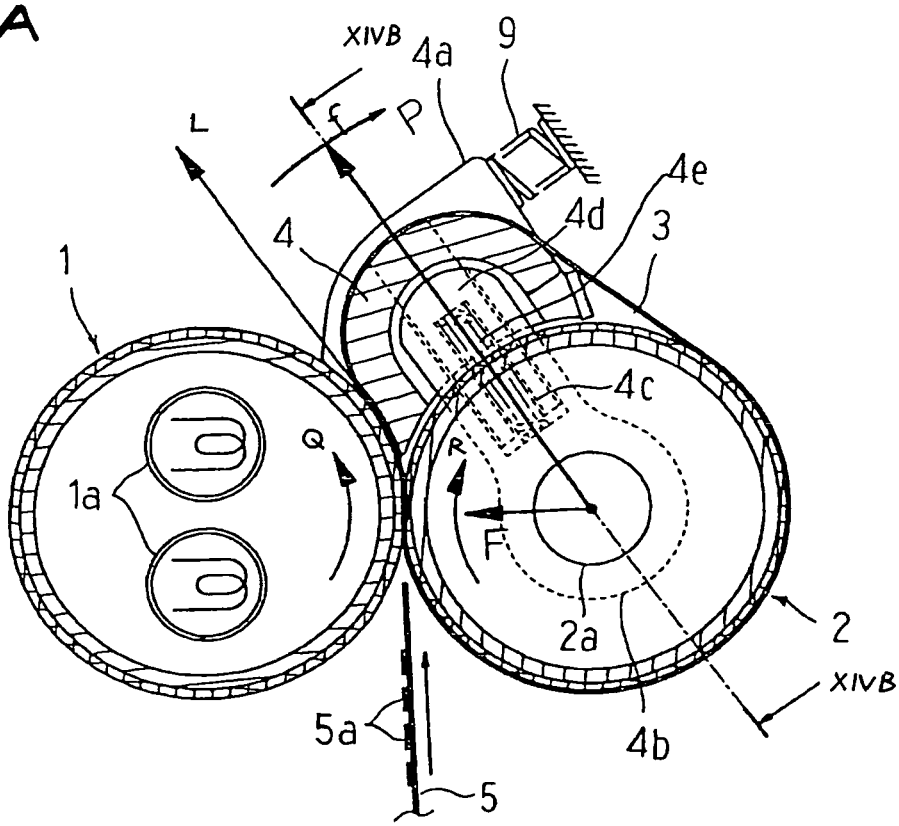
FIG. 14A is a section view of a fixing device according to a fourth embodiment of the invention.
Figure 14B:
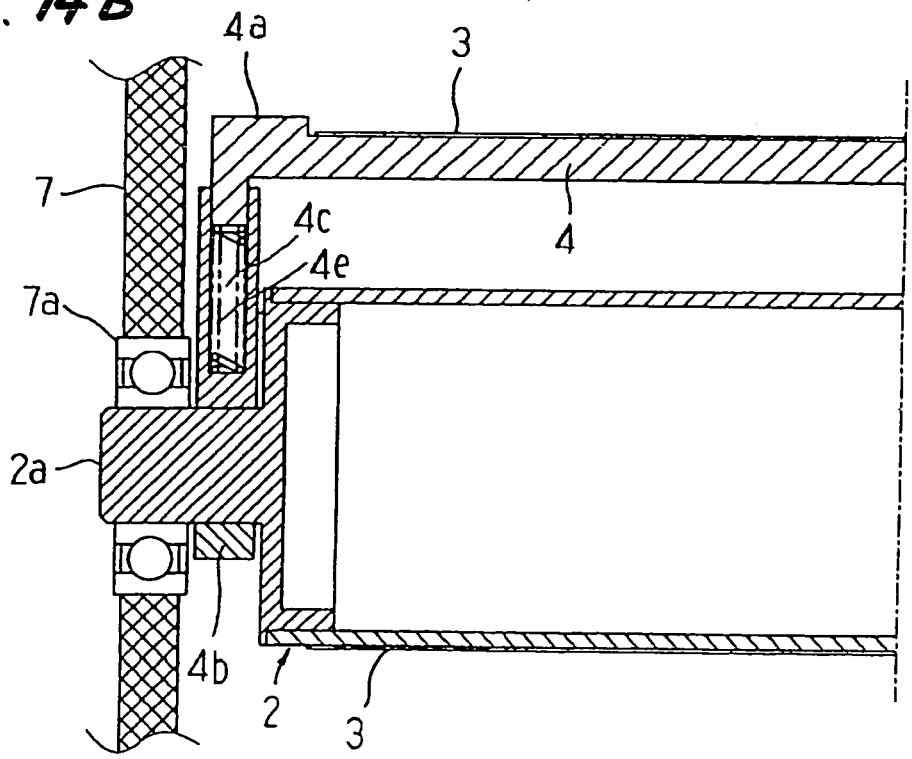
FIG. 14B is a partial section view taken along a line XIVB—XIVB of FIG. 14A.

In this embodiment, the belt stretcher 4 is provided downstream of the press contact portion between the heating roller 1 and the pressing roller 2 in the transportation direction of a sheet medium 5, and is allowed to pivot in the direction indicated by an arrow P about the rotary shaft 2*a* of the pressing roller 2, as shown in FIGS. 14A and 14*b*.

The belt stretcher 4 is a semiannular member which is disposed in an inner periphery of the heat-resistant so as to provide a tensile force f to the belt in cooperation with the pressing roller 2. Accordingly, the belt 3 slides on the semiannular member.

An entrance of the fixing nip is defined as a position at which the belt stretcher 4 is slightly pressed against the heating roller 1, and an exit of the fixing nip is defined as a position at which the belt stretcher 4 is separated from the heating roller 1. A sheet medium 5 enters from the nip entrance and passes a space between the belt 3 and the heating roller 1 so that an unfixed toner image 5*a* is fixed on the sheet medium 5. The sheet medium 5 is then discharged from the nip exit in the direction of the tangential line L.

Figures 15A, 15B:
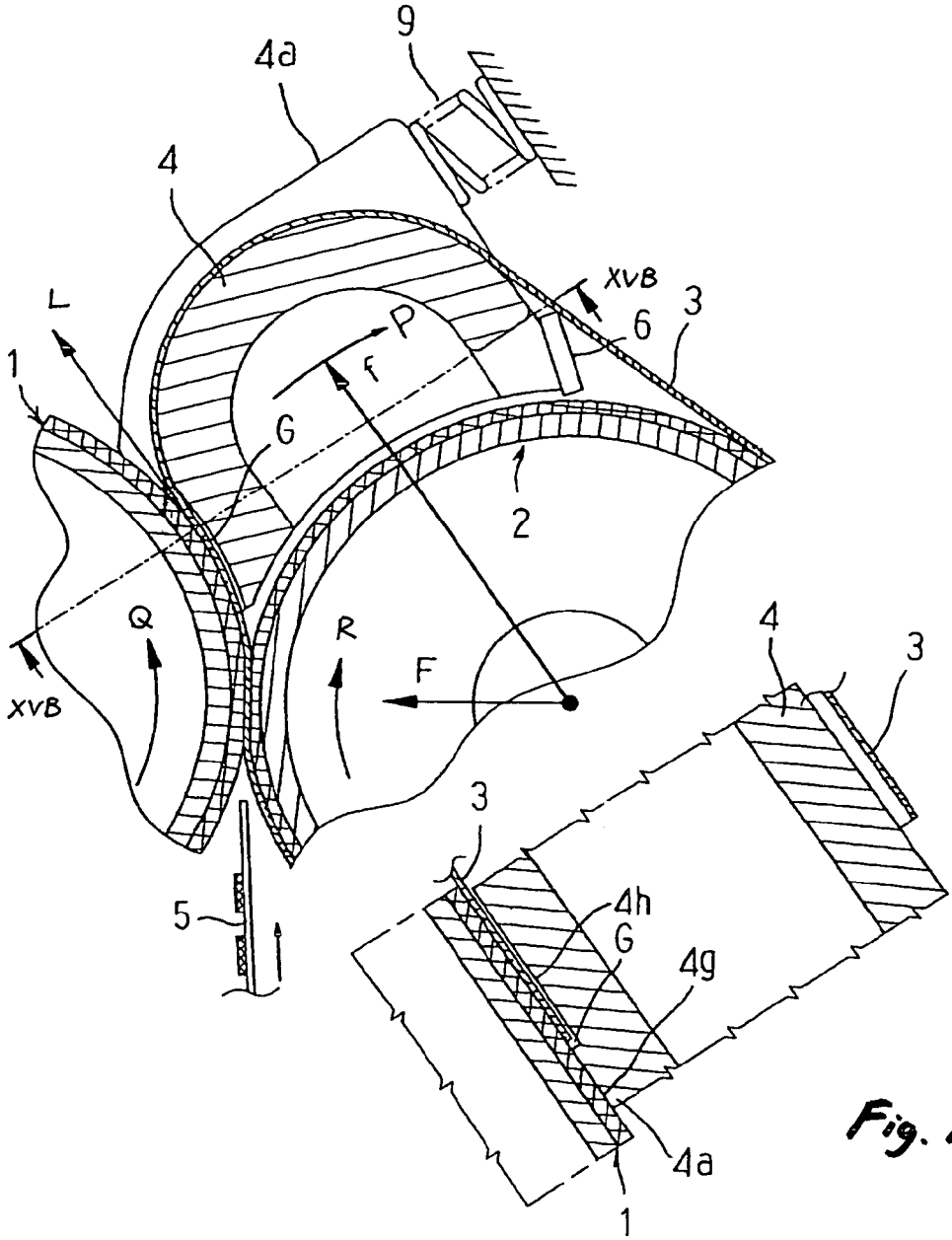
FIG. 15A is a partial section view of a press contact portion of a belt stretcher and a heating roller in the fixing device of FIG. 14A, showing a state before a sheet medium enters the press contact portion.
FIG. 15B is a partial section view taken along a line XVB—XVB of FIG. 15A.

As is shown in FIGS. 15A and 15B, the protruding wall 4*a* of the belt stretcher 4 is positioned by coming in sliding contact with the heating roller 1 on a slide-contact surface 4*g*. A gap (step difference) G, which is larger than the thickness of the belt 3, is provided to the belt stretcher 4 between the slide-contact surface 4*g* and a pressing surface 4*h* that presses the belt 3 and thereby presses a sheet medium 5 against the heating roller 1. The pressing surface 4*h* is formed concentrically with the heating roller 1. To be more concrete, by forming the gap G from a step difference of about 110 μm, and forming the belt 3 to have a thickness of about 80 μm, a clearance of about 30 μm is secured, which enables the fixing to be performed in a stable manner even for a sheet medium 5 as thick as 60 μm.

The belt 3 is nipped between the heating roller 1 and the pressing roller 2, and is brought into press contact with the heating roller 1 by the belt stretcher 4 at the exit of the nip region.

In this embodiment, in the foregoing state while no sheet medium 5 is passing through, the gap G is formed between the belt 3 and the belt stretcher 4. Hence, the clearance in the gap G serves as a heat insulation layer during the warm-up. A heat quantity absorbed from the heating roller 1 via the belt 3 is thus lessened, and so is a heat loss. The warm-up time, therefore, can be shortened.

Figures 16A, 16B:
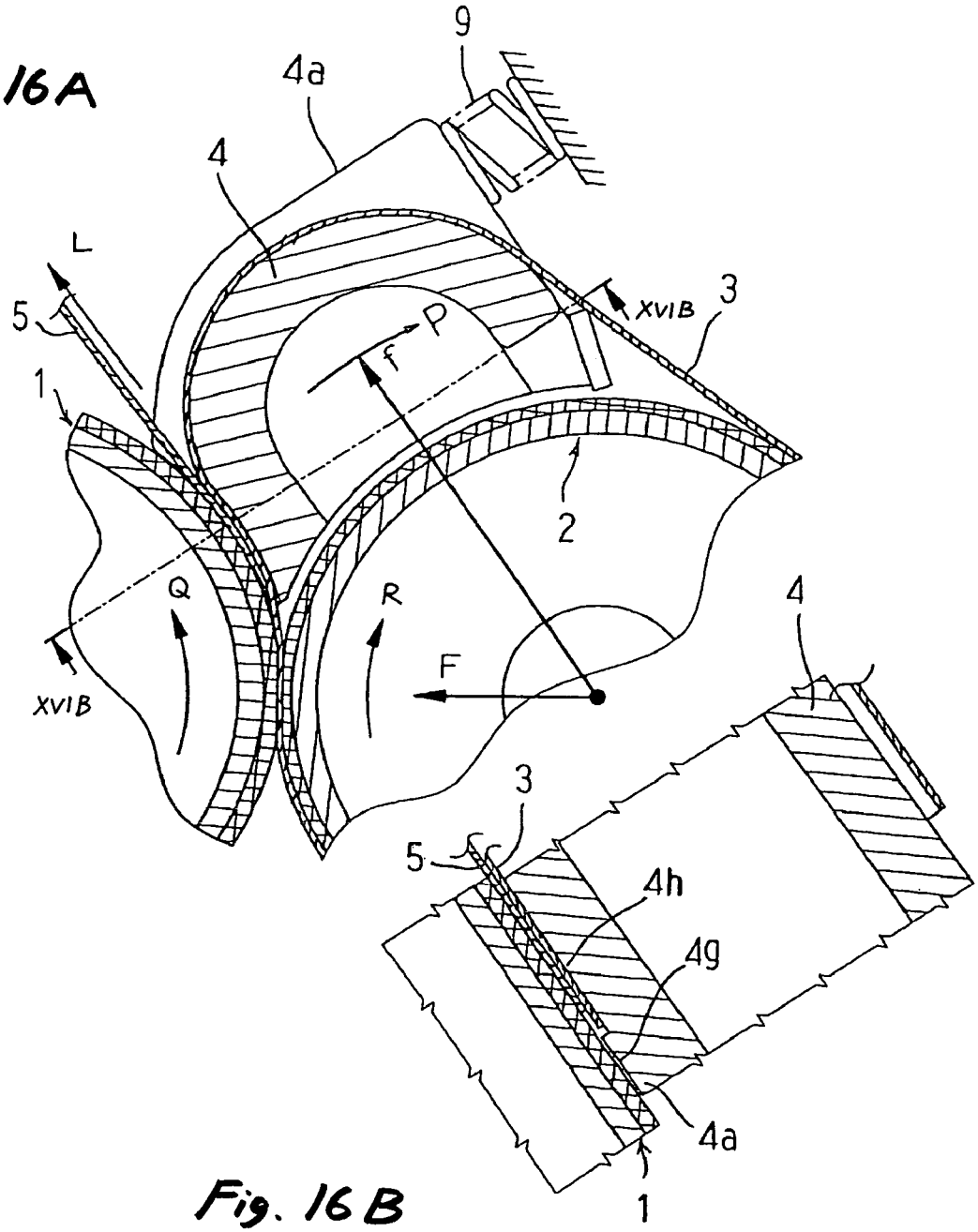
FIG. 16A is a partial section view of the press contact portion, showing a state that the sheet medium is discharged from the press contact portion.
FIG. 16B is a partial section view taken along a line XVIB-XVIB of FIG. 16A.

On the other hand, when a sheet medium 5 is passing through the fixing nip portion, as is shown in FIGS. 16A and 16B, the protruding wall 4*a* of the belt stretcher 4 is kept spaced apart from the heating roller 1, which eliminates the gap G between the belt 3 and the belt stretcher 4. The sheet medium 5 is thereby pressed by the belt 3 at the fixing nip portion, and hence pressed against the heating roller 1, which makes it possible to achieve adequate fixing by adjusting this pressing force to a desired pressure with the use of the spring 9 shown in FIG. 14A.

Also, a heat quantity, accumulated while the belt stretcher 4 is heated by the heating roller 1, is small due to the presence of the gap G. Hence, when the sheet medium 5 enters the nip portion, the second surface of the sheet medium 5 opposite to the first surface on which the unfixed toner image 5*a* is formed cools the belt 3 having a small heat capacity. Since a heat quantity supplied from the belt stretcher 4 side is small, in a case of double-sided image fixing to fix an unfixed toner image 5*a* on the second surface after the unfixed toner image 5*a* formed on the first surface of the sheet medium 5 is fixed, the image fixed earlier on the first surface is not excessively heated when the second surface undergoes fixing, and no disturbance occurs in the image fixed on the first surface.

The belt 3 is driven when either the heating roller 1 and the pressing roller 2 is driven, and the belt stretcher 4 starts to pivot in a direction to move away from the heating roller 1 by this driving force and the sliding-frictional force between the belt 3 and the belt stretcher 4. However, by setting a desired fixing pressure by pushing the belt stretcher 4 toward the heating roller 1 by a desired pushing force larger than the pivotal moving force, it is possible to fix an unfixed toner image 5*a* in an extremely stable manner.

Hence, in this embodiment, the spring 9 is provided downstream of the press contact portion between the heating roller 1 and the pressing roller 2 in the moving direction of the belt 3, which is remote from the pivot center of the belt stretcher 4.

Figure 17:
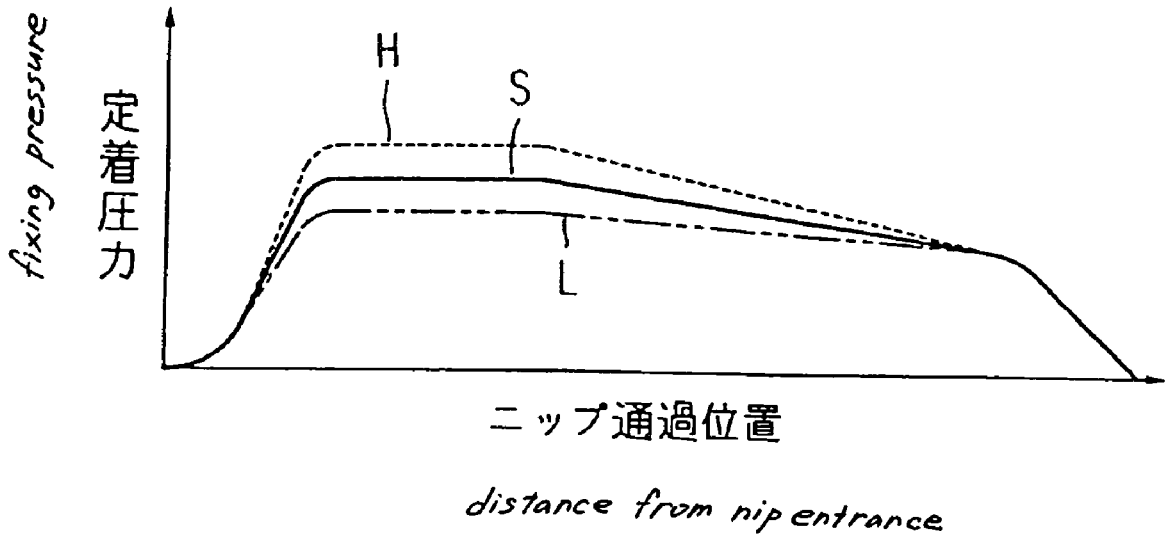
FIG. 17 is a graph showing fixing pressure variation generated by the belt stretcher of FIG. 14A in a case where a spring for assisting the pivot movement of the belt stretcher is provided.

In this embodiment, the spring 9 is provided downstream of the press contact portion between the heating roller 1 and the pressing roller 2 in the moving direction of the belt 3, which is remote from the pivot center of the belt stretcher 4. Hence, as is shown in FIG. 17, it is possible to increase the fixing pressure continuously from the nip entrance toward the press contact portion between the heating roller 1 and the pressing roller 2 due to the mechanism of leverage, and a stress having an inflection point is not applied to a sheet medium 5. Hence, no fixing irregularities or the like are generated in a fixed image, which not only enables an unfixed toner image 5*a* to be fixed in an extremely stable manner, but also the sheet medium distortion, such as the occurrence of wrinkles, can be suppressed for a sheet medium 5 discharged after the unfixed toner image 5*a* is fixed.

Incidentally, "H" denotes the case of a thick sheet medium or a layered sheet medium such as an envelop, having a large heat capacity, or a transparent sheet medium such as an OHP sheet, "S" denotes the case of a standard sheet medium, and "L" denotes a thin sheet medium or a sheet medium having a poor heat resistance.

Figure 18A:
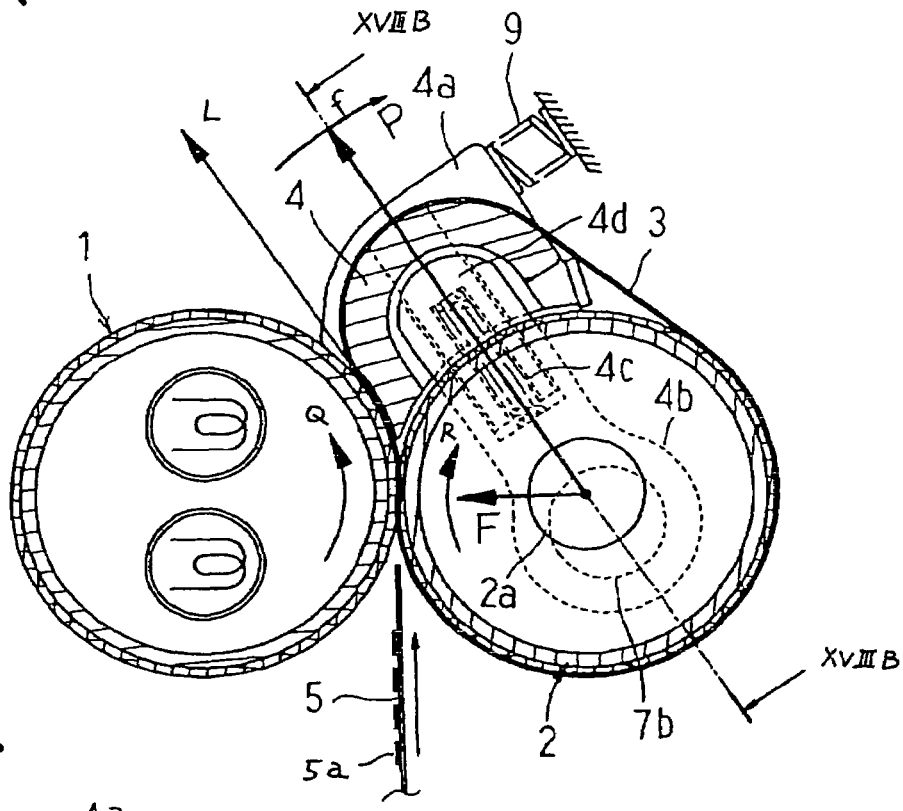
FIG. 18A is a section view of a fixing device according to a fifth embodiment of the invention.
Figure 18B:
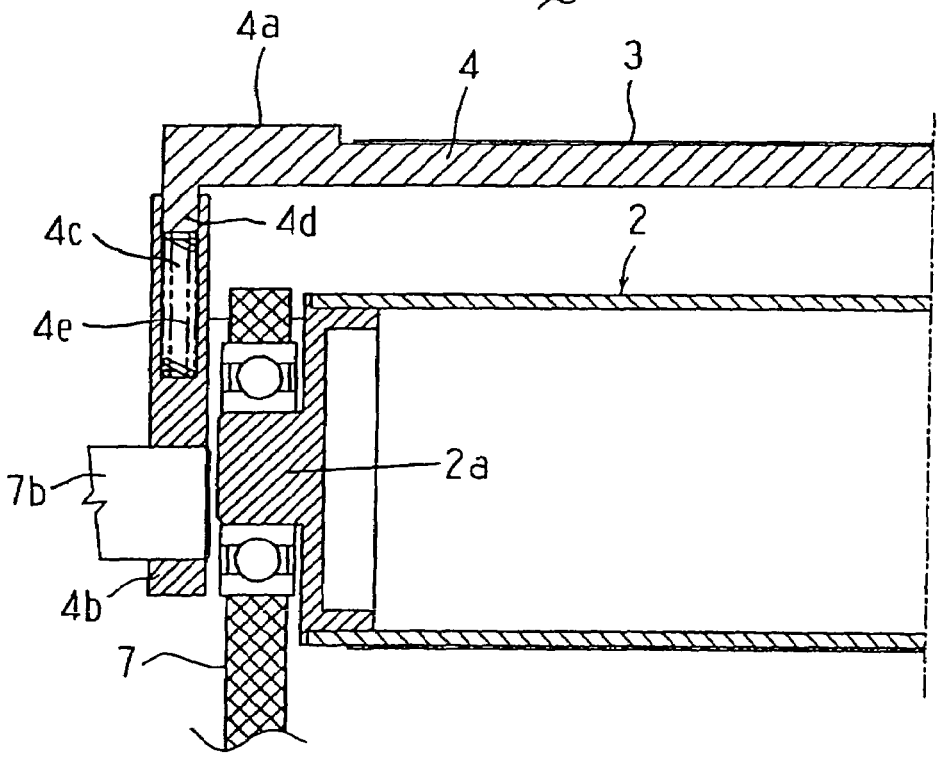
FIG. 18B is a partial section view taken along a line XVIIIB-XVIIIB of FIG. 18A.

FIGS. 18A and 18B show a fixing device according to a fifth embodiment of the invention. Members similar to those in the fourth embodiment are designated by the same reference numerals and the repetitive explanations for those will be omitted.

In the fourth embodiment, the belt stretcher 4 is allowed to pivot by a predetermined angle about the common axis with the rotary shaft 2*a* of the pressing roller 2. In this embodiment, the belt stretcher 4 is configured so as to be allowed to pivot by a predetermined angle about an axis 7*b*, which is different from the rotary shaft 2*a* of the pressing roller 2.

In other words, on the both sides of the axis 7*b* provided at a position different from the axial center of the rotary shaft 2*a* are fitted arms 4*b* to be free to pivot, and a guiding groove 4*c* is formed in each arm 4*b* so as to face the belt stretcher 4. On the other hand, at the both ends of the belt stretcher 4 are formed guiding portions 4*d* to be fitted into the guiding grooves 4*c* in the arms 4*b* via springs 4*e*. The belt stretcher 4 is therefore of a structure such that provides a tensile force f to the belt 3 as it is pushed by the springs 4*e* in a direction to move away from the pressing roller 2.

This configuration can change the torque acting on the belt stretcher 4 (in this embodiment, the torque is increased), which makes it possible to adjust the press-contact force between the belt 3 and the heating roller 1 in accordance with the position of the axis 7*b*.

In the above embodiments, the heating roller 1 or the pressing roller 2 serves as the driving roller. In this case, in order to achieve the safe driving, it is preferable to use either roller whichever is the harder as the driving roller and the other softer roller as the driven roller. The belt 3 is wound around the pressing roller 2 to be circulated, and is brought into press contact with the elastic body 1*c* coated on the surface of the heating roller 1. In this case, since the pressing roller 2 serves as the driving roller and the heating roller 1 serves as the driven roller, the pressing roller 2 determines the transportation speed of the belt 3, that is, of a sheet medium 5 bearing an unfixed toner image 5*a*. The pressing roller 2 is configured to have a harder surface than at least the elastic body 1*c*. This configuration enables the driving with a stable transportation speed to be achieved without causing distortion.

In the above embodiments, the rotational speed of the heating roller 1 and the pressing roller 2 may be selectably controlled. The control of the driving speed will now be described. A driving member has two rotational speeds to drive the heating roller 1 and the pressing roller 2, and drives the heating roller 1 and the pressing roller 2 selectively at a first rotational speed or a second rotational speed slower than the first rotational speed, according to the sheet medium properties.

In order to set the rotational speed, a detector for detecting the sheet medium properties is provided, and a table or the like for selecting the rotational speed corresponding to the sheet medium properties is also provided. The sheet medium properties are detected while a sheet medium 5 bearing an unfixed toner image 5*a* is being transported, and the rotational speed is selected according to the detected sheet medium properties through the table when the fixing command is processed.

To select the rotational speed, the members interlocked with the fixing device may be manually operated before the fixing command is processed, or remotely controlled by an electrical signal or the like.

The sheet medium 5 bearing the unfixed toner image 5*a* must be used in diversified purposes, including a typical sheet medium of paper or the like, a thick sheet medium having a large heat capacity, a transparent sheet medium (OHP sheet), etc. In comparison with a typical sheet medium, for a thick sheet medium and a layered sheet medium, such as an envelope, having a large heat capacity, a transparent sheet medium (OHP sheet medium), etc., a relatively long time period is needed to melt the unfixed toner image 5*a* sufficiently before it is fixed thereon. In such a case, by selectively driving the heating roller 1 and the pressing roller 2 at the first rotational speed or the second rotational speed slower than the first rotational speed according to the sheet medium properties, the unfixed toner image 5*a* is melted adequately, and the fixing as desired can be achieved.

In addition, even by the selective driving at the first rotational speed or the second rotational speed, a stress, applied to a sheet medium 5 bearing an unfixed toner image 5*a* when the sheet medium 5 passes through a space between the heating roller 1 and the belt 3, varies little and remains small. This suppresses the sheet medium distortion, such as the occurrence of the wrinkles, for the sheet medium 5 discharged after the unfixed toner image 5*a* is fixed thereon. Hence, not only can the need to increase the mechanical rigidity of the heating roller type fixing apparatus be eliminated, but also the heating roller 1 can be thinner. A heating speed with which the heat source heats the belt 3 can be thus increased. In addition, because the pressing roller 2 can be thinner, too, a heat capacity can be smaller. Heat energy absorbed from the belt 3 is thus lessened, which makes it possible to shorten a so-called warm-up time needed to reach a predetermined temperature for the fixing to be enabled since the apparatus has been activated. The selective driving may be realized by, for example, selectively changing the rotational speed of a driving motor.

Figure 19:
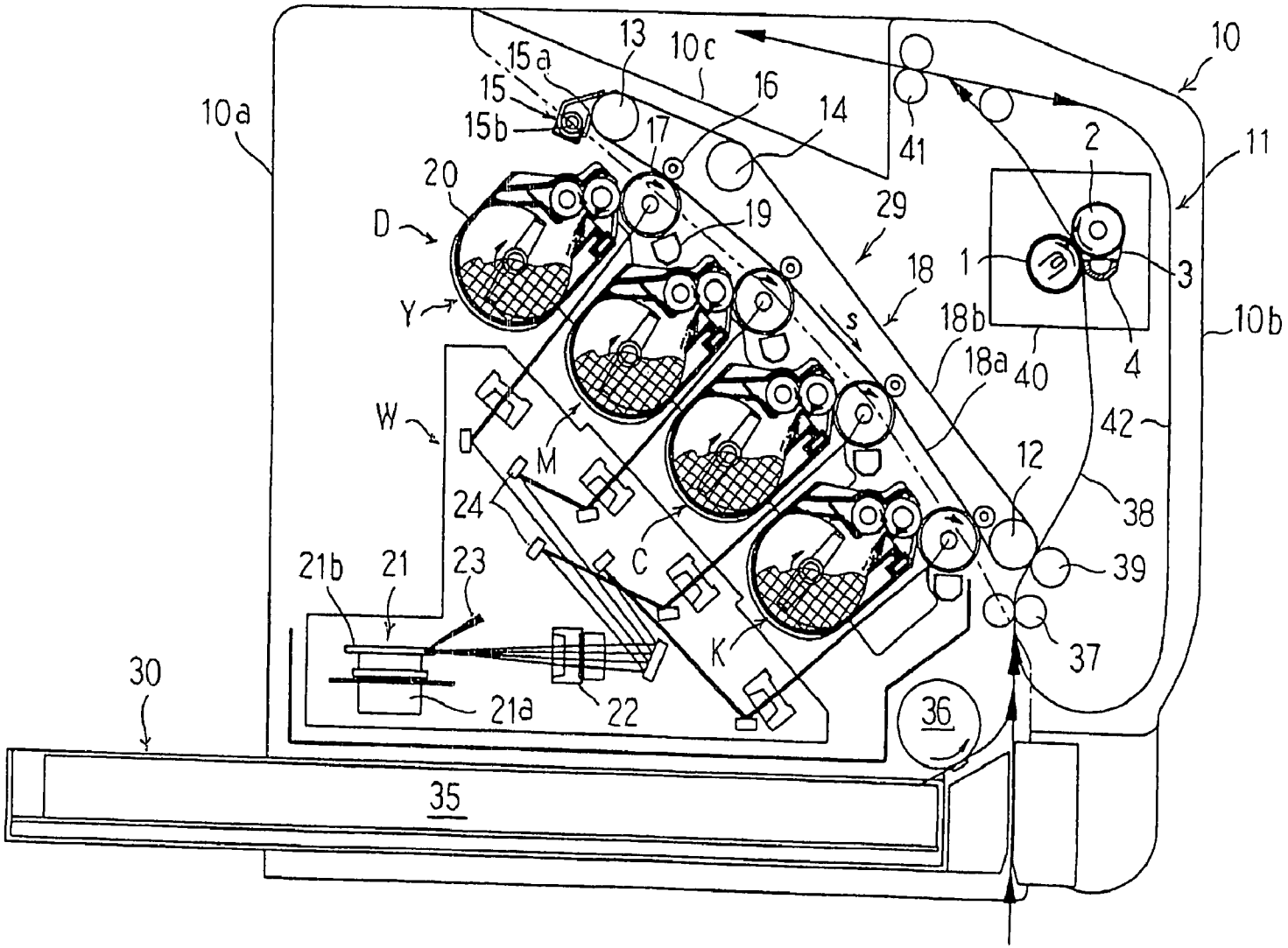
FIG. 19 is a schematic section view of an image forming apparatus incorporating any one of the fixing devices.

FIG. 19 shows an image forming apparatus 10 incorporating any one of the fixing devices as described the above.

The image forming apparatus 10 includes a housing 10*a*, a medium discharging tray 10*c* formed on the top portion of the housing 10*a*, and a door cover 10*b* attached at the front of the housing 10*a* to be free to open and close. Inside the housing 10*a* are provided an exposure unit W, an image formation unit D, a transfer belt unit 29 having an image transporter 18, and a medium feeding unit 30. In the vicinity of the door 10*b* is provided a medium transportation unit 11. Each unit is detachably loaded inside the housing 10*a*, so that any one of the units can be individually detached from the housing 10*a* during a maintenance work or the like for repairing or replacement.

The image formation unit D includes plural (four, in the embodiment) image forming stations Y (for yellow), M (for magenta), C (for cyan), and K (for black), each forming an image of a different color. Each of the image forming stations Y, M, C, and K includes an image carrier 17 comprising a photosensitive drum, as well as a charger 19 comprising a corona charger and a development device 20 both provided in the periphery of the image carrier 17. The respective image forming stations Y, M, C, and K are provided in parallel below the transfer belt unit 29 along an arch-shaped line with the image carriers 17 facing upward. The placement order of the respective image forming stations Y, M, C, and K is arbitrary.

The transfer belt unit 29 includes a driving roller 12 driven to rotate by an illustrated driving source provided at the lower end of the housing 10*a*, a driven roller 13 provided diagonally above the driving roller 12, a tension roller 14, the image transporter 18 comprising an intermediate transfer belt stretched over these three rollers or at least two of them and driven to circulate in a direction indicated by an arrow S, and a cleaner 15 that abuts on the surface of the image transporter 18. The driven roller 13, the tension roller 14, and the image transporter 18 are arranged such that the circulating path of the image transporter 18 extends obliquely. More specifically, they are arranged such that a belt surface 18*a* faced down in the belt transportation direction is positioned lower and a belt surface 18*b* faced up in the belt transportation direction is positioned upper.

Thus, the image forming stations Y, M, C, and K are arrayed obliquely. The belt surface 18*a* of the image transporter 18 comes in contact with the image carriers 17 along the arch-shaped line, and the image carriers 17 are then driven to rotate in the transportation direction of the image transporter 18 as indicated by arrows. The flexible image transporter 18 in the shape of an endless sleeve comes in contact with the image carriers 17 at almost the same winding angle to cover the image carriers 17 from above. This configuration makes it possible to adjust a press-contact pressure or a nip width between the image carriers 17 and the image transporter 18 by controlling a tensile force applied to the image transporter 18 from the tension roller 14, placement intervals of the image carriers 17, the winding angle (the curvature of the arch), etc.

The driving roller 12 also serves as a back-up roller of a secondary transfer roller 39. On the peripheral surface of the driving roller 12 is formed a rubber layer having, for example, a thickness of about 3 mm and a volume resistivity of $10^5$ Ωcm or less, and the grounding via a metal shaft is used as an electrical conduction path of the secondary bias provided via the secondary transfer roller 39. In this manner, by providing the driving roller 12 with the rubber layer having high friction and impact absorbing ability, an impact when a sheet medium enters the secondary transfer portion is hardly transmitted to the image transporter 18, which makes is possible to prevent deterioration of the image quality. In addition, by making the diameter of the driving roller 12 smaller than the diameters of the driven roller 13 and the back-up roller 14, a sheet medium, having undergone the secondary transfer, can be separated more readily by its own elastic force. Further, the driven roller 13 is used also as a back-up roller of the cleaner 15 described below.

Alternatively, the inclined direction of the circulating path of the image transporter 18 is arbitrary and the array of the image forming stations Y, M, C, K is determined accordingly.

The cleaner 15 is provided on the side of the belt surface 18*a* faced down in the transportation direction, and is provided with a cleaning blade 15*a* that removes toner remaining on the surface of the image transporter 18 after the secondary transfer, and a toner transporter 15*b* that transports collected toner. The cleaning blade 15*a* abuts on the image transporter 18 at the winding portion of the image transporter 18 to the driven roller 13. On the back side of the image transporter 18 abuts a primary transfer member 16 oppositely to the image carriers 17 of the respective image forming stations Y, M, C, and K described below, and the transfer bias is thus applied to the primary transfer portion 16.

The exposing unit W is provided in a space below the image formation unit D obliquely arrayed. Also, the medium feeding unit 30 is provided at the bottom of the housing 10*a* below the exposing unit W. The exposing unit W is accommodated in the case entirely, and the case is provided in a space formed diagonally below the belt surface 18*a* faced down in the transportation direction. At the bottom of the case are provided horizontally a single scanner 21 comprising a polygonal mirror motor 21*a*, a polygonal mirror (rotary multi-faceted mirror) 21*b*. In an optical system B, which reflects laser beams from plural laser light sources 23 modulated by image signals of their respective colors on the polygonal mirror 21*b* to be deflected and scanned on the respective image carriers 17, are provided a single f-θ lens 22 and plural reflection mirrors 24 that return scanning light paths of respective colors to the corresponding image carriers 17 not in parallel with each other.

In the exposing unit W configured as described above, image signals, corresponding to respective colors, from the polygonal mirror 21*b* are emitted in the form of laser beams formed and modulated according to the common data clock frequency, and irradiated to the image carriers 17 in the respective image forming stations Y, M, C, and K by way of the f-θ lens 22 and the reflection mirrors 24 for a latent image to be formed. The scanning light path is bent by providing the reflection mirrors 24, and the height of the case can be thereby lowered, which in turn makes it possible to achieve a compact optical system.

Moreover, the reflection mirrors 24 are set so that the lengths of the scanning light paths to the image carriers 17 in the respective image forming stations Y, M, C, and K are all equal. By configuring in such a manner that the lengths of light paths (light path lengths) to the respective image carriers 17 from the polygonal mirror 21*b* in the exposing unit W become nearly equal with respect to the image formation unit D, the scanning widths of light beams scanned via the respective light paths also become nearly equal. This eliminates the need for a special configuration to form image signals. Hence, the laser light source is modulated by different image signals for images of different colors; nevertheless, it can be modulated according to the common data clock frequency, and because the common reflection surface is used, color shifting induced from a relative difference in the sub-scanning directions can be prevented. It is thus possible to fabricate an inexpensive color image forming apparatus with a simple structure.

Further, in this apparatus, by providing the scanning optical system on the lower side of the apparatus, it is possible to minimize vibrations of the scanning optical system induced by vibrations given to the frame supporting the image forming apparatus from the driving system in the apparatus, which can in turn prevent deterioration of the image quality. In particular, by providing the scanner 21 at the bottom of the case, vibrations given to the entire housing 10*a* from the polygonal motor 21*a* per se can be minimized, and deterioration of the image quality can be prevented. Also, by limiting the number of the polygonal motor 21*a*, serving as the vibration source, to one, vibrations given to the entire case can be minimized.

The medium feeding unit 30 is provided with a cassette tray 35 in which a pile of sheet media are held, and a pick-up roller 36 that feeds the sheet media from the feed cassette 35 one by one. The medium transportation unit 11 is provided with a pair of gate rollers 37 that regulates the feed timing of a sheet medium to the secondary transfer portion (one of the rollers is provided on the housing 10*a* side), the secondary transfer roller 39 that is brought into pressing contact with the driving roller 12 and the image transporter 18, a main transportation path 38, a fixing unit 40, a pair of discharging rollers 41, and a double-sided printing transportation path 42.

An unfixed toner image secondarily transferred on a sheet medium is fixed at the nip portion formed by the fixing unit 40 at a predetermined temperature. In this embodiment, it is possible to provide the fixing unit 40 in a space formed diagonally above the belt surface 18*b* of the transfer belt, which is faced up in the transportation direction, in other words, a space on the opposite side of the image forming stations Y, M, C, and K, with respect to the transfer belt. This configuration can reduce heat to be transmitted to the exposing unit W, the image transporter 18, and the image forming means, and the frequency of a color-shift correcting operation for respective colors can be reduced. In particular, the exposing unit W is at the remotest position from the fixing unit 40, and distortion caused by heat in the scanning optical system components can be minimized, which can in turn prevent a shift in color.

In this embodiment, because the image transporter 18 is extended diagonally, a wide space can be secured on the right side of the drawing for providing the fixing unit 40. Hence, not only can the apparatus be made compact, but also transmission of heat, generated in the fixing unit 40, to the exposure unit W, the image transporter 18, and the respective image forming stations Y, M, C, and K, all positioned on the left side of the drawing, can be prevented. Also, because the exposure unit W can be provided in a space on the lower left of the image formation unit D, vibrations of the scanning optical system in the exposure unit W, induced by vibrations given to the housing 10*a* from the driving system in the image formation unit D, can be minimized, which can in turn prevent the deterioration of the image quality.

Because no cleaner is provided, the corona charger 19 is adopted as the charger. In a case where the charger comprises a roller, primary transfer residual toner present on the image carrier 17 accumulates on the roller, albeit in a slight quantity, and gives rise to a charging defect. However, toner hardly adheres to the corona charger 19, which is non-contact charger. The occurrence of a charging defect, therefore, can be prevented.

In this apparatus, the intermediate transfer belt serves as the image transporter 18 and is configured to come in contact with the image carriers 17. However, the image transporter 18 may be a sheet medium transportation belt that attracts a sheet medium on the surface and moves to transport the sheet medium in transferring toner images sequentially to be superposed on the surface of the sheet medium, and is configured to come in contact with the image carriers 17. In this case, the belt transportation direction of the sheet medium transportation belt serving as the image transporter 18 is made upward on the lower surface that comes in contact with the image carriers 17.

It should be appreciated that the invention is not limited to the above embodiments, and can be modified in various manners. For example, although a tandem-type color image forming apparatus in which the development devices of respective colors are arrayed has been described the above, the invention can be applied to a rotary-type color image forming apparatus, in which the development devices of respective colors are mounted to the rotary frame, as well as to a monochrome image forming apparatus.

What is claimed is:

1. A fixing device for fixing an unfixed toner image formed on a sheet-shaped recording medium, the fixing device comprising:

a first roller, incorporating a heat source therein;

a second roller, being pressed toward the first roller;

an endless belt, a part of which is wound on an outer periphery of the second roller to be circulated; and a non-rotatable belt stretcher, which stretches the endless belt together with the second roller such that the circulated endless belt is slid on a first face extending in a widthwise direction of the endless belt, and such that a tensile force is applied to both widthwise end portions of the endless belt, wherein:

the circulated endless belt is nipped between the first roller and the second roller to form a first nip portion through which the unfixed toner image is fixed on the recording medium with heat from the heat source; and the first face of the belt stretcher is curved in the widthwise direction of the endless belt.

2. The fixing device as set forth in claim 1, wherein a widthwise center portion of the first face of the belt stretcher is made concave from the both widthwise end portions thereof.

3. The fixing device as set forth in claim 1, wherein a widthwise center portion of the first face of the belt stretcher is made convex from the both widthwise end portions thereof.

4. The fixing device as set forth in claim 1, wherein the circulated endless belt faces the first roller with a gap to form a second nip portion through which the unfixed toner image is fixed on the recording medium with heat from the heat source.

5. The fixing device as set forth in claim 4, wherein the belt stretcher comprises a wall member having a second face adjacent to at least one of the both widthwise end portions of the endless belt, in order to restrict a wobbling motion of the circulated endless belt.

6. The fixing device as set forth in claim 5, wherein the wall member is integrally formed with the belt stretcher.

7. The fixing device as set forth in claim 6, wherein the wall member is monolithically formed with the belt stretcher.

8. The fixing device as set forth in claim 6, wherein the second face of the wall member is continuously extended from the first face of the belt stretcher.

9. The fixing device as set forth in claim 8, wherein:

the second face of the wall member and the first face of the belt stretcher facing one of the widthwise end portions of the endless belt form a first angle; and a side end face of the endless belt and the first face of the belt stretcher facing one of the widthwise end portions of the endless belt form a second angle which is smaller than the first angle.

10. The fixing device as set forth in claim 5, wherein a height dimension of the wall member is larger than a thickness dimension of the endless belt.

11. The fixing device as set forth in claim 5, wherein the wall member is formed with a chamfered face continued to the second face to guide the circulated endless belt into the first face of the belt stretcher.

12. The fixing device as set forth in claim 5, wherein a part of the wall member is abutted against the first roller to define a gap between the first roller and the first face of the belt stretcher at the second nip portion.

13. The fixing device as set forth in claim 12, wherein:

a distance between the first roller and the first face of the belt stretcher at the gap is larger than a thickness dimension of the endless belt; and the distance is determined such that the first face of the belt stretcher presses the recording medium against the first roller through the endless belt when the recording medium enters the second nip portion.

14. The fixing device as set forth in claim 1, wherein the belt stretcher is pivotable.

15. The fixing device as set forth in claim 14, further comprising an elastic member which urges the belt stretcher toward the first roller.

16. The fixing device as set forth in claim 14, wherein a pivot center of the belt stretcher is identical with a rotational axis of the second roller.

17. The fixing device as set forth in claim 14, wherein a pivot center of the belt stretcher is different from a rotational axis of the second roller.

18. The fixing device as set forth in claim 1, wherein the belt stretcher has a semiannular cross section viewed from the widthwise direction of the endless belt.

19. The fixing device as set forth in claim 18, further comprising a cleaner disposed between the second roller and the belt stretcher so as to abut against an inner peripheral face of the endless belt.

20. The fixing device as set forth in claim 1, wherein the belt stretcher has a circular cross section viewed from the widthwise direction of the endless belt.

21. The fixing device as set forth in claim 1, wherein the belt stretcher is disposed at an upstream side in the circulating direction of the endless belt relative to the first nip portion.

22. The fixing device as set forth in claim 1, wherein the belt stretcher is disposed at a downstream side in the circulating direction of the endless belt relative to the first nip portion.

23. An image forming apparatus, comprising:

an image forming device, which forms a toner image on a recording medium; and the fixing device as set forth in claim 1 for fixing the toner image on the recording medium.

24. A fixing device for fixing an unfixed toner image formed on a sheet-shaped recording medium, the fixing device comprising:

a first roller, incorporating a heat source therein;

a second roller, being pressed toward the first roller;

an endless belt, a part of which is wound on an outer periphery of the second roller to be circulated;

a non-rotatable belt stretcher, which stretches the endless belt together with the second roller such that the circulated endless belt is slid on a first face extending in a widthwise direction of the endless belt, and such that a tensile force is applied to both widthwise end portions of the endless belt, and a wall member, having a second face adjacent to at least one of the both widthwise end portions of the endless belt in order to restrict a wobbling motion of the circulated endless belt, wherein the circulated endless belt is nipped between the first roller and the second roller to form a first nip portion through which the unfixed toner image is fixed on the recording medium with heat from the heat source; and the first face of the belt stretcher is curved in the widthwise direction of the endless belt.

* * * * *